US009233827B2

(12) United States Patent
Wanless

(10) Patent No.: US 9,233,827 B2
(45) Date of Patent: Jan. 12, 2016

(54) VARIOUS CONTAINER ATTACHABLE ONE-HANDED CONTROLLABLE PNEUMATIC FLUID DISPENSING APPARATUS WITH VENT VALVE

(71) Applicant: Michael Charles Wanless, Redding, CA (US)

(72) Inventor: Michael Charles Wanless, Redding, CA (US)

( * ) Notice: Subject to any disclaimer, the term of this patent is extended or adjusted under 35 U.S.C. 154(b) by 26 days.

(21) Appl. No.: 13/832,125

(22) Filed: Mar. 15, 2013

(65) Prior Publication Data

US 2014/0263470 A1 Sep. 18, 2014

(51) Int. Cl.
*B65D 83/00* (2006.01)
*B67D 7/02* (2010.01)

(52) U.S. Cl.
CPC ..... *B67D 7/0294* (2013.01); *B67D 7/0266* (2013.01)

(58) Field of Classification Search
CPC .. B67D 1/0832; B67D 7/0294; B67D 7/0266; B05B 15/005
USPC ..... 222/400.7, 55, 61, 400.8
See application file for complete search history.

(56) References Cited

U.S. PATENT DOCUMENTS 3,156,252 A * 11/1964 Johnston ..... 137/212
4,180,189 A * 12/1979 Zurit et al. ..... 222/400.7
4,291,821 A * 9/1981 Nezworski ..... 222/153.04
4,612,952 A * 9/1986 Fallon ..... 137/212
5,265,653 A 11/1993 Herlth
5,427,505 A 6/1995 Payne
5,636,656 A * 6/1997 Hubbard ..... 137/212
5,636,657 A * 6/1997 Degenkolbe et al. ..... 137/212
5,645,192 A * 7/1997 Amidzich ..... 222/1
5,690,136 A * 11/1997 Celli ..... 137/212
5,738,499 A 4/1998 Evans
6,357,492 B1 3/2002 Hsu
6,412,669 B1 7/2002 Chuang
6,722,389 B2 4/2004 Stevens
7,044,404 B1 5/2006 Kricheldorf
8,322,569 B2 * 12/2012 Udischas et al. ..... 222/3
2009/0184133 A1 * 7/2009 Hasegawa et al. ..... 222/95
2010/0243676 A1 * 9/2010 Bax et al. ..... 222/148

FOREIGN PATENT DOCUMENTS

AU WO9208897 5/1992

* cited by examiner

*Primary Examiner* — Patrick M Buechner
*Assistant Examiner* — Jeremy W Carroll
(74) *Attorney, Agent, or Firm* — John P. O'Banion

(57) ABSTRACT

Various container attachable pneumatic fluid dispensing apparatus (20), which includes a variety of differently configured container adapters (40); a latching coupler (50) for connecting the fluid dispensing apparatus to variously configured containers; a pressure relief valve (90-120) and also an orifice (236) limit the pneumatic dispensing force; a hand-controllable valve (230) along with cylindrical valve body (70) direct the pneumatic dispensing force into and out of a container (30); a fluid dispensing tube (190) co-axially and slidably attaches to the valve body and communicates with the fluid (31) of the container, with space between its exterior wall and the valve body interior wall to provide a passage for the pneumatic force to enter and exit the container. The dispensing tube has a release lever (210) for dispensing tube adjustment or removal; a filter (320) in pneumatic connector (370) filters the pneumatic dispensing force.

20 Claims, 22 Drawing Sheets

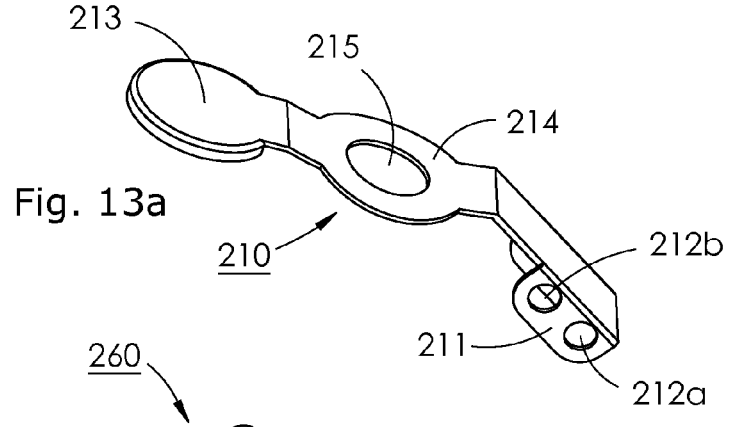
Fig. 13a
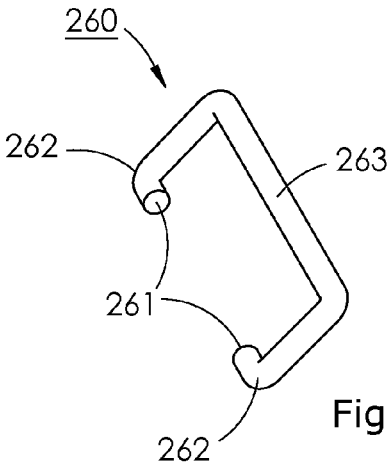
Fig. 13b
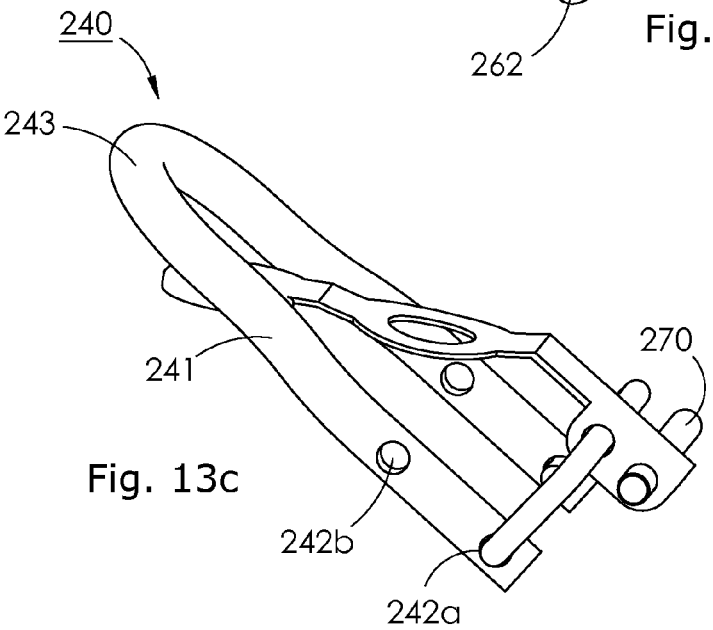
Fig. 13c
Fig. 13

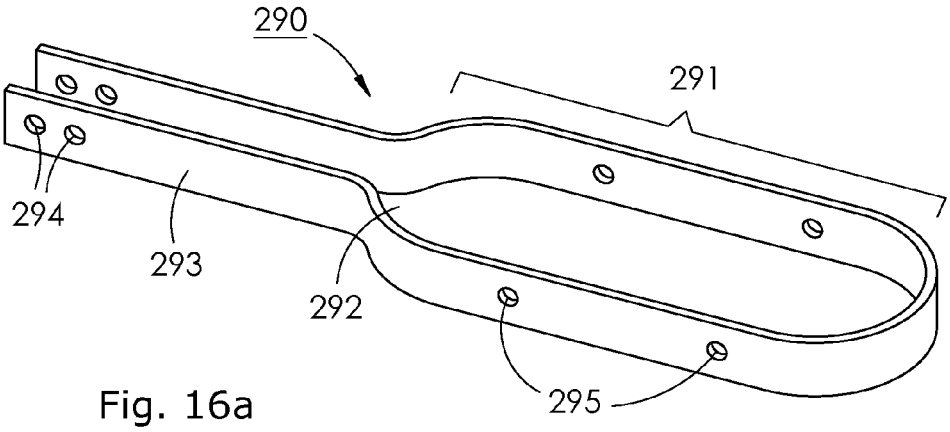
Fig. 16a
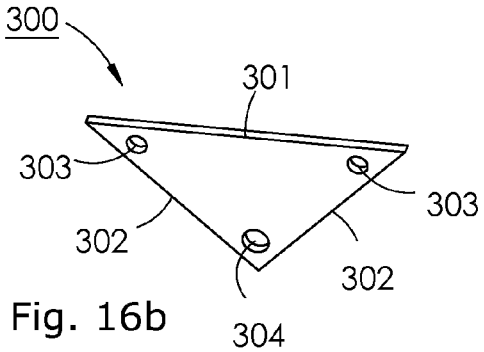
Fig. 16b
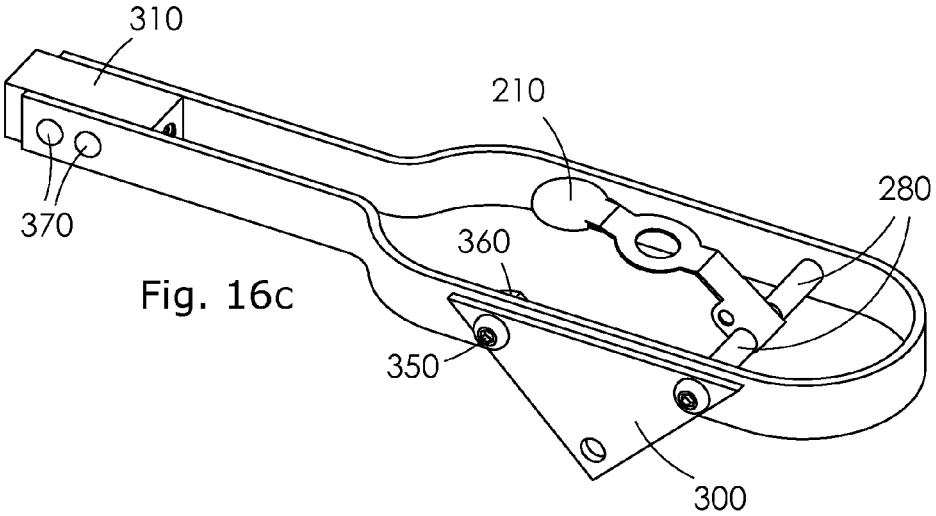
Fig. 16c
Fig. 16

Fig. 21a
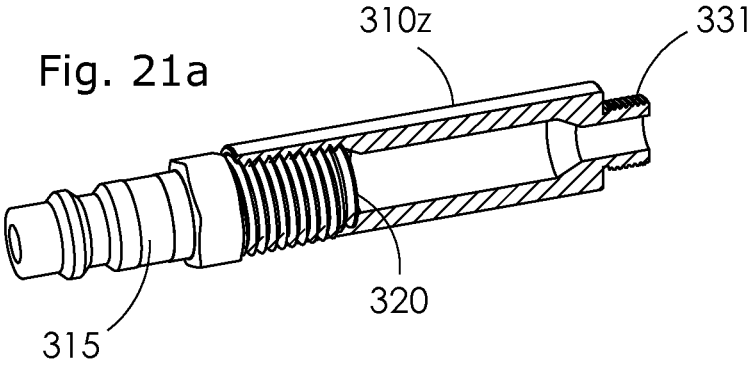
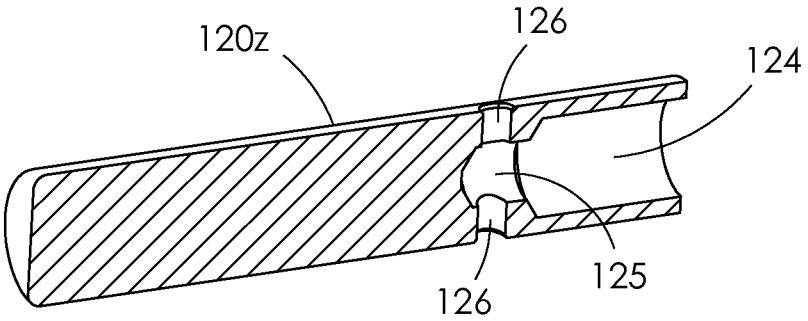
Fig. 21b
Fig. 21

VARIOUS CONTAINER ATTACHABLE ONE-HANDED CONTROLLABLE PNEUMATIC FLUID DISPENSING APPARATUS WITH VENT VALVE

BACKGROUND

This application relates generally to the dispensing arts, particularly pneumatic powered.

PRIOR ART

The following is a tabulation of some prior art that presently appears relevant:

| U.S. Patents | | | |
|---|---|---|---|
| U.S. Pat. No. | Kind Code | Issue Date | Patentee |
| 7,044,404 | B1 | 2006 May 16 | Kricheldorf |
| 6,722,389 | B2 | 2004 Apr. 20 | Stevens |
| 6,412,669 | B1 | 2002 Jul. 02 | Chuang |
| 6,357,492 | B1 | 2002 Mar. 19 | Hsu |
| 5,738,499 | A | 1998 Apr. 14 | Evans |
| 5,427,505 | A | 1995 Jun. 27 | Payne |
| 5,265,653 | A | 1993 Nov. 30 | Herlth |
| 3,156,252 | | 1964 Nov. 10 | Johnston |

| Foreign Patent Documents | | | |
|---|---|---|---|
| Intl. Pub. No. | Intl. Patent Cl. | Intl. Pub. Dt. | App or Patentee |
| WO9208897 | F04F 1/06, B67D 5/54 | 1992 May 29 | McCormick Donald Murray |

NONPATENT LITERATURE DOCUMENTS

Samson model 1320, 1322, 1327 portable pressurized dispensers, http://samsoncorporation.com/Mityvac MV6400 fluid dispensing system, http://www.mityvac.com Motorcraft Transporter Fluid Evacuator/Injector #307-D465, https://rotunda.spx.com.

Atec Transporter Fluid Evacuator-Injector, http://atec-transtool.com/pdfs/att_auto_tools.pdf.

Page 3 of the above pdf claims it is U.S. Pat. No. 5,738,499. It may also be the same tool as Motorcraft Transporter Fluid Evacuator/Injector.

Varieties of fluids are stored and shipped in various containers for end user application. Many of these containers are thin-walled plastic containers. For example, machinery lubricants such as those used in motor vehicle gear cases, come in a wide variety of viscosities and types of fluids. Some of these gear cases are underneath a vehicle, and cannot be filled by pouring from a container into the gear case fill hole due to various component obstructions around the area of the gear case fill hole, such as a vehicle frame, floor pan, exhaust system, etc.

Originally these gear cases were filled with fluids using a pump and container dedicated to the particular type and viscosity of fluid required. The pump and container were either portable or stationary. The pumps were usually piston, or gear type pumps. These were powered electrically, pneumatically, or pumped manually.

In the past, most gear cases typically used one type of fluid, 90 wt. gear oil. Presently, a modern motor vehicle can use 75W-90 standard gear oil in the front axle, and 75W-140 synthetic gear oil in the rear axle. Also, a special type of fluid in the transfer case, and another special type of fluid in the automatic transmission, and still another in the manual transmission.

Kricheldorf, Hsu, Evans, and Payne show a pneumatic fluid delivery system without a pump that uses a gas pressure internal to the container which causes fluid to flow from the container through a conduit exiting the container. All of these devices utilize their own dedicated container, that cannot be quickly and easily flushed to prevent cross contamination of fluids when switching fluid types. Although Chuang, Herlth, Johnston, and McCormick do not require their own dedicated containers, they do not connect to a variety of container openings.

Stevens's liquid transfer apparatus discloses an adapter which connects to a variety of container openings, but does not securely attach the liquid transfer apparatus to the adapter, requiring a person to constantly maintain the connection. This would not be adequate for a connection that is pressurized. This also would not permit the container to be transported by lifting only the apparatus, without it being securely attached to the adapter. Another disadvantage of Stevens's adapter is that it has to be manufactured using at least two parts, which then must be assembled together to form the adapter. Stevens's apparatus also does not pressurize the container for liquid transfer. Moreover, Stevens's apparatus still has to rely on its own built-in container to operate. Furthermore, Stevens's apparatus is in fact not a fluid dispensing apparatus, but rather, a liquid transfer apparatus.

Samson, Motorcraft, Atec, and Mityvac dispensers also use a dedicated container that cannot be quickly and easily flushed, and are not adaptable to a variety of containers. All of the pneumatic fluid dispensers heretofore known suffer from a number of disadvantages:

(a) The fluid dispensers in present cannot be quickly and securely attached and detached to a variety of containers, necessitating in many cases a transfer of the desired fluid from its original container to a container compatible with the fluid dispenser, which requires additional time spent performing the procedure.

(b) When switching to a different type of fluid, the container first has to be flushed to prevent cross-contamination of fluids. This too requires more time and effort.

(c) When the container is low on fluid and needs to be refilled, the gas pressure inside the container has to be vented before the container can be opened. Once the air supply is turned off in Kricheldorf, Chuang, Hsu, and Herlth dispensers, the air pressure inside the container equalizes to the air pressure external to the container only after enough fluid has exited the container to cause an increase in the air space inside the container, resulting in a decreased pressure. This brings up yet another problem: the fluid continues to dispense after shutting off the air, until the air pressure inside the container equalizes to the air pressure outside the container. The problem is amplified when the fluid volume in the container is low, and the air space is large. Also, the larger the container, the more noticeable the problem is.

(d) The Payne, Johnston, and McCormick dispensers rely on a fluid shut-off valve in the fluid outlet line to stop the fluid from flowing. The air pressure in the container can only be vented by cracking open the fluid fill cap and letting the air escape, or if the dispenser permits, by having to disconnect the air supply, and letting the air escape by back-flowing through the air supply inlet. Having to wait for the air pressure to escape increases the amount of time it takes to refill the container.

(e) The depth of the fluid dispensing conduit in the container cannot be quickly and easily adjusted, and then securely locked in place to facilitate rapid adapting to a different depth container; or for quick changing; or cleaning of the fluid conduit. This is necessary when switching fluid types.

(f) The dispensers in present have limits to the amount of air pressure they can tolerate before damaging the dispenser or causing explosive failure of the container and contents. This puts humans at risk of injury. This requires the air supply to be regulated, making it necessary for the user to be sure the inlet air is properly regulated to the correct pressure. Otherwise, the dispenser would have to be equipped with an air pressure regulator, and a safety pressure relief valve, which adds substantial costs to the dispenser.

(g) The gas, or air source, for powering the dispensers in present has to be clean to keep contaminants from entering the fluid through the dispenser. Also, one must be careful to make sure that there is no dirt or contaminants on the air supply connection of the dispenser when attaching it to the air supply in order to prevent contaminating the fluid.

SUMMARY

In accordance with one embodiment, a pneumatic fluid dispensing apparatus comprises an adapter to connect to various openings of a plurality of fluid containers. In accordance with one embodiment, a pneumatic fluid dispensing apparatus comprises a locking coupling for securely attaching the apparatus to the container adapter. In accordance with one embodiment, a pneumatic fluid dispensing apparatus comprises a controllable valve for applying and venting the air pressure in the container. In accordance with one embodiment, a pneumatic fluid dispensing apparatus comprises an air pressure relief valve to limit the air pressure in the container, in combination with an inlet air restriction to limit the air flow volume for fluid dispensing. In accordance with one embodiment, a pneumatic fluid dispensing apparatus comprises a fluid dispensing tube quick release lever. In accordance with one embodiment, a pneumatic fluid dispensing apparatus comprises a filter for the fluid dispensing air supply.

Advantages

Thus several advantages of one or more aspects are as follows: to provide a more versatile fluid dispensing apparatus that can be used on a variety of containers, including thin-walled plastic containers, that is faster to use, that results in more controlled dispensing, that is cheaper to manufacture, that is easier to service, that is less costly to repair, that is safer to use, that produces sanitary results, that is simpler to operate, and also that is a one-handed controllable, and transportable, with-the-container-attached fluid dispensing apparatus. These and other advantages of one or more aspects will become apparent from a consideration of the ensuing description and accompanying drawings.

DRAWINGS

Figures

Figure 14:
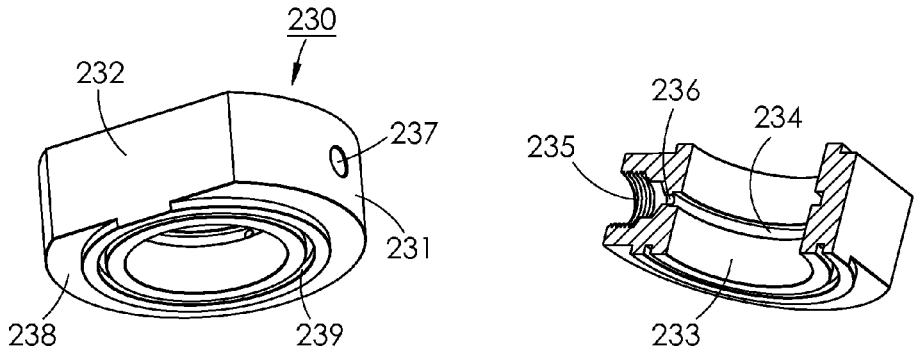
Figure 15:
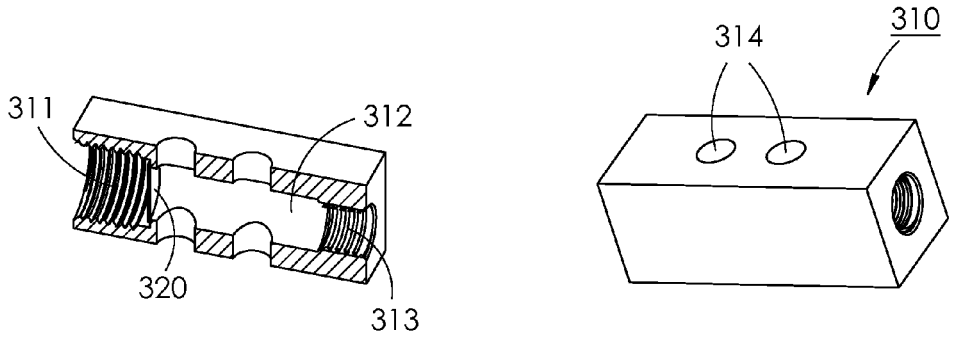
Figure 17:
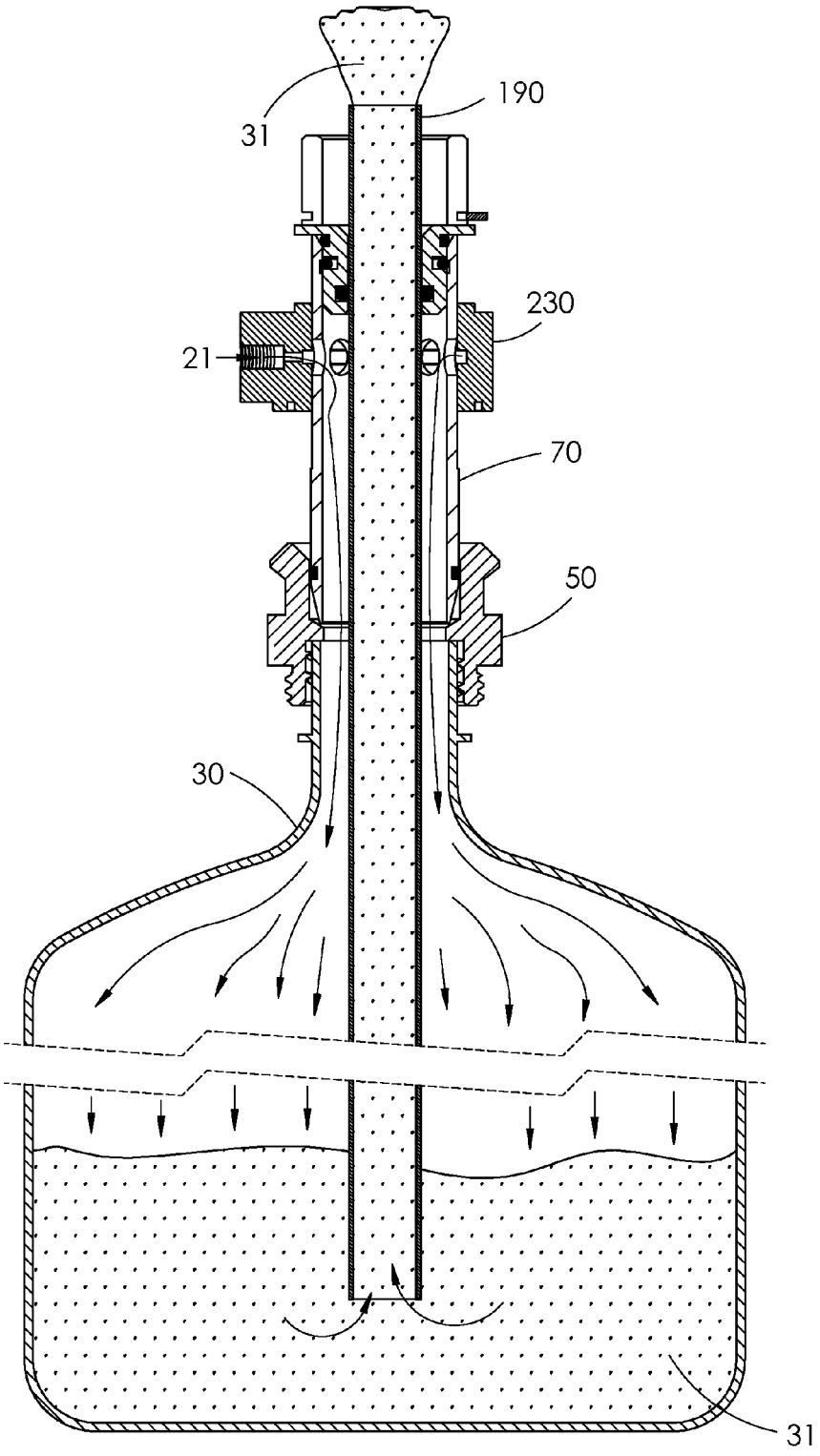
Figure 18:
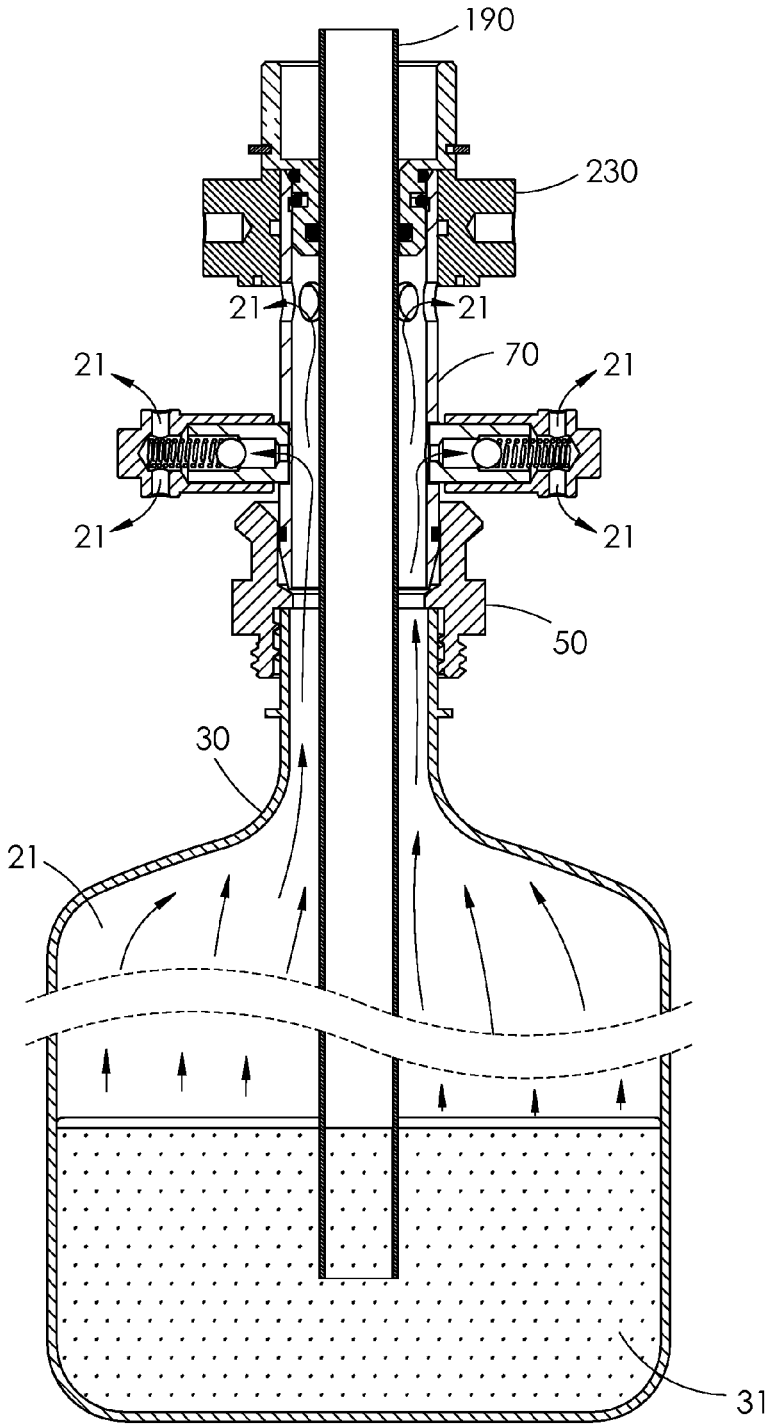
Figure 19:
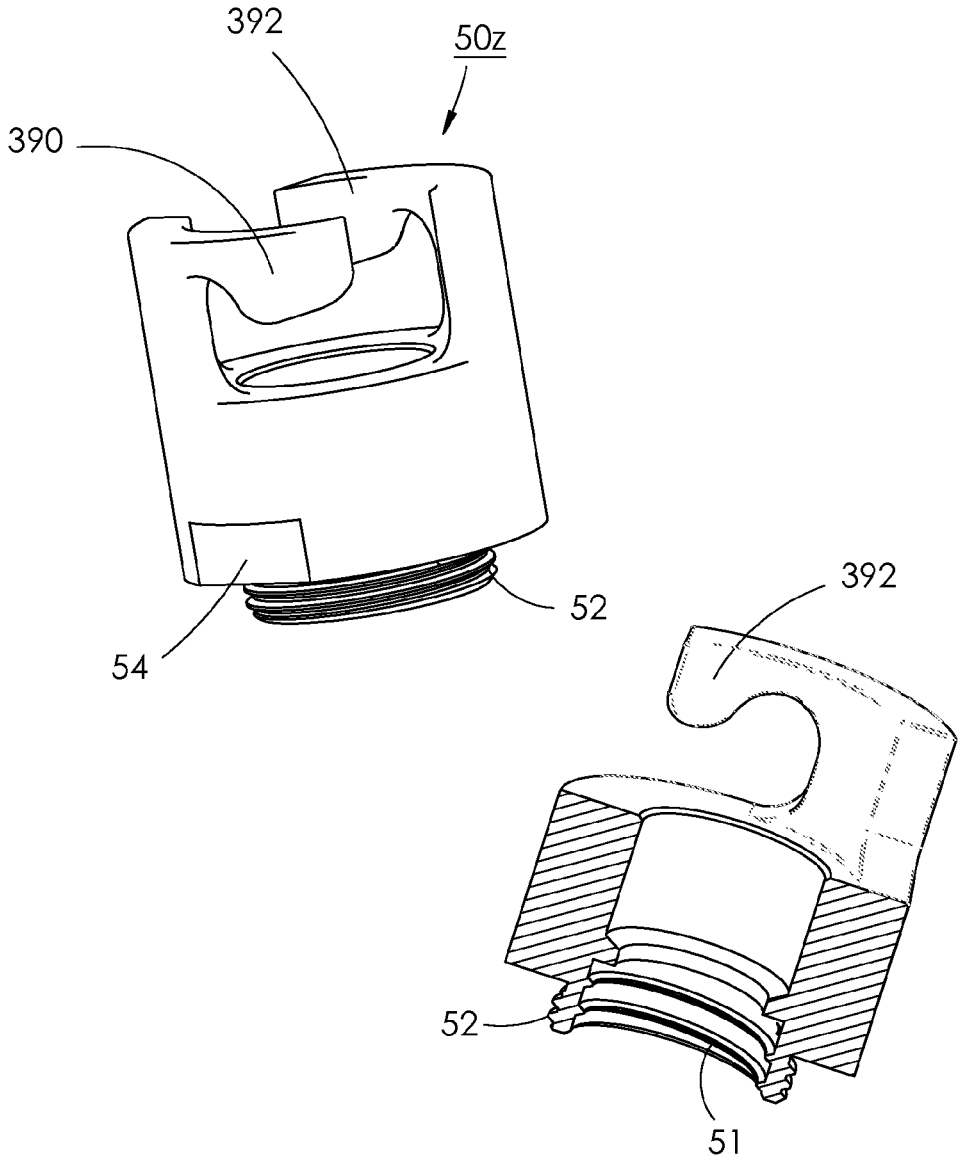
Figure 20:
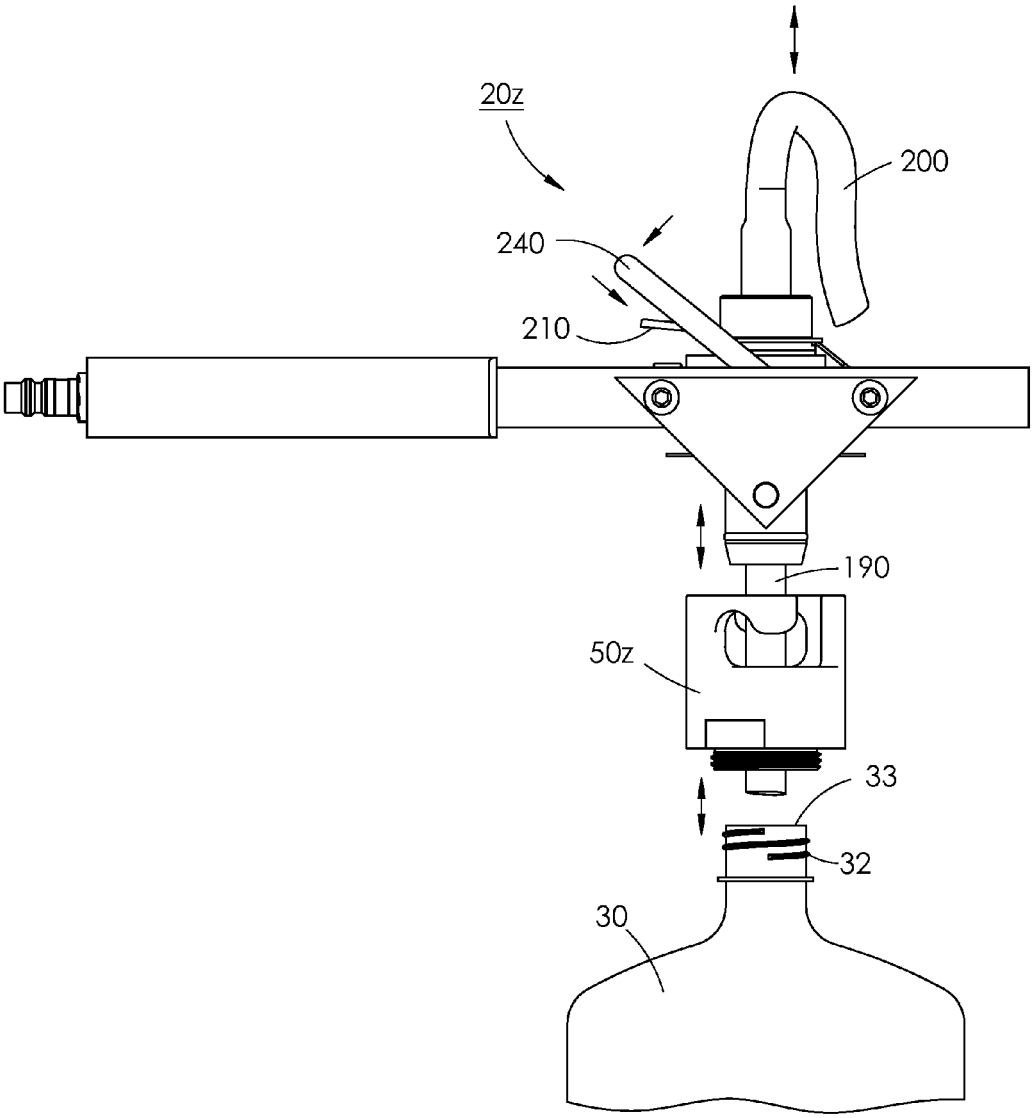
Figure 22:
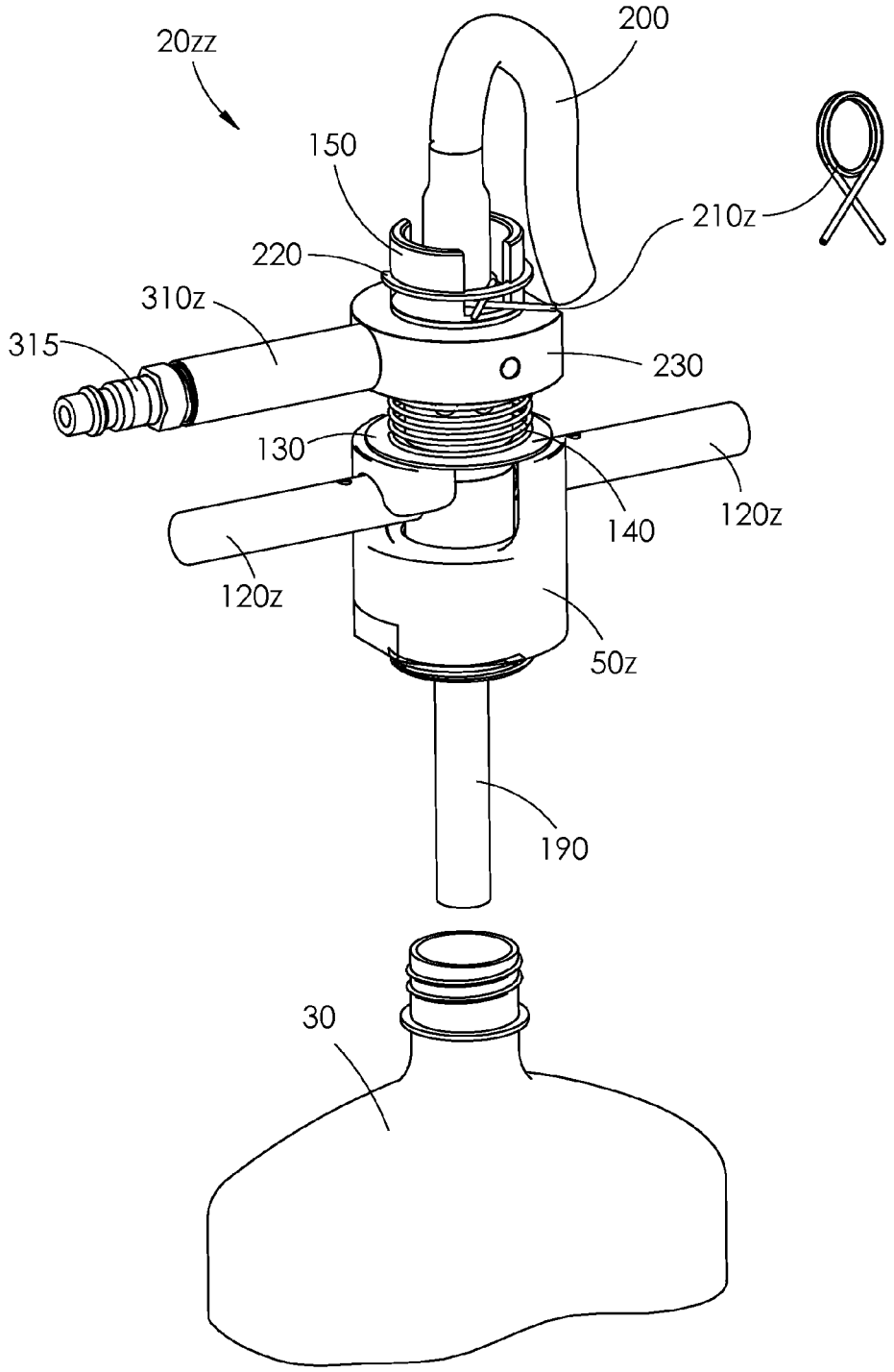
Figure 23:
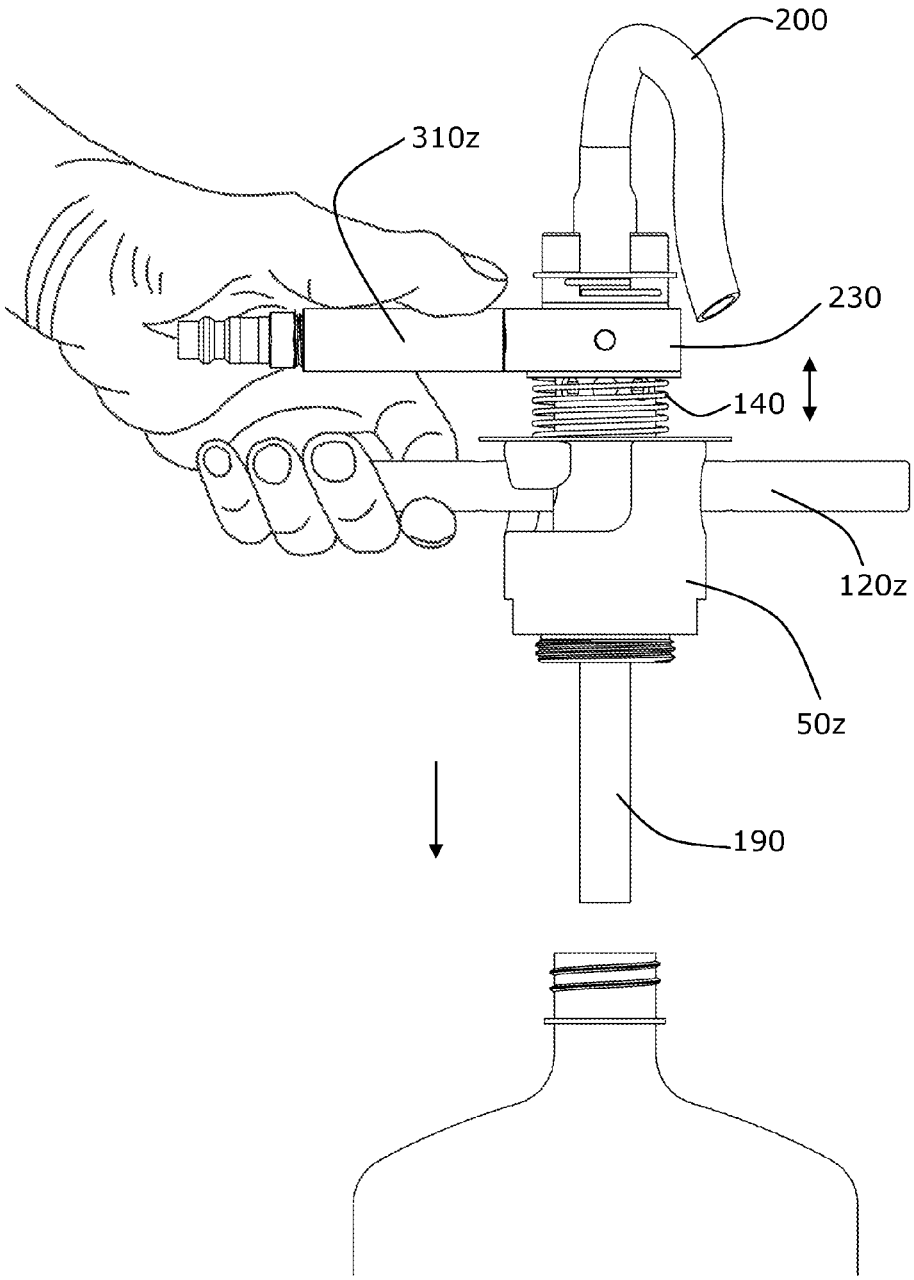

FIG. 13*a* is a perspective view of the tube release lever;

FIG. 13*b* is a perspective view of the lever pivot linkage;

FIG. 13*c* is a perspective view of the valve actuation lever connected to the tube release lever by the lever pivot linkage, and also shows the placement of the anchor pin in the tube release lever;

FIG. 14 is a perspective view, and cross-section view of the pneumatic valve;

FIG. 15 is a perspective view, and cross-section view of the pneumatic connector;

FIG. 16*a* is a perspective view of the handle;

FIG. 16*b* is a perspective view of the mounting plate;

FIG. 16*c* is a perspective view of the handle with pneumatic connector, one mounting plate and tube release lever and with some components omitted for clarity;

FIG. 17 is a right side cross-section view of the apparatus attached to a container with the valve in the open position showing the fluid dispensing from air pressure being applied, with some components omitted for clarity;

FIG. 18 is a front, or back cross-section view of the apparatus attached to a container with the valve in the closed position showing the air pressure being vented, with some components omitted for clarity;

FIG. 19 is a perspective and cross-section view of an adapter-coupler of an alternative embodiment;

FIG. 20 is a right side view of an additional embodiment dispensing apparatus disconnected from the container and adapter-coupler of FIG. 19;

FIG. 21*a* is a cross-section view of a pneumatic connector of an alternative embodiment;

FIG. 21*b* is a cross-section view of a check valve outer housing/handle of an alternative embodiment;

FIG. 22 is a perspective view of an alternative embodiment dispensing apparatus;

FIG. 23 is a side view of an alternative embodiment dispensing apparatus showing a hand holding the dispensing apparatus, and positioned to activate the dispensing apparatus.

REFERENCE NUMERALS

| | | | |
|---|---|---|---|
| 20. | Fluid dispensing apparatus | 30. | Container, fluid/liquid |
| 40. | Adapter, container | 50. | Coupler |
| 40/50. | Adapter-coupler | 60. | Latch (2) |
| 70. | Valve body | 80. | O-ring, valve body to coupler |
| 90. | Housing, inner, pressure relief valve (2) | 100. | Ball, pressure relief valve (2) |
| 110. | Spring, pressure relief valve (2) | 120. | Housing, outer, pressure relief valve (2) |
| 130. | Washer, spring seat and latch return | 140. | Spring, latch and valve return |
| 150. | Bushing, fluid dispensing tube guide | 160. | Retaining ring, round wire |
| 170. | O-ring, guide bushing to valve body | 180. | O-ring, guide bushing to dispensing tube |
| 190. | Dispensing tube, fluid | 200. | Hose, dispensing tube extension |
| 210. | Lever, dispensing tube release | 220. | Retaining ring, rectangular |
| 230. | Valve, pneumatic | 240. | Lever, valve actuation |
| 250. | Pin, connecting (2) | 260. | Linkage, lever pivot |
| 270. | Pin, anchor | 280. | Post, mounting (2) |
| 290. | Handle | 300. | Mounting plate (2) |
| 310. | Connector, pneumatic | 320. | Disc screen, inlet air filtering |
| 330. | Fitting, tubing quick connect (2) | 340. | Tubing, air supply |
| 350. | Bolt, mounting plate attaching (4) | 360. | Nut (2) |
| 370. | Rivet, pneumatic connector mounting (2) | 380. | Cover |

Figure 1:
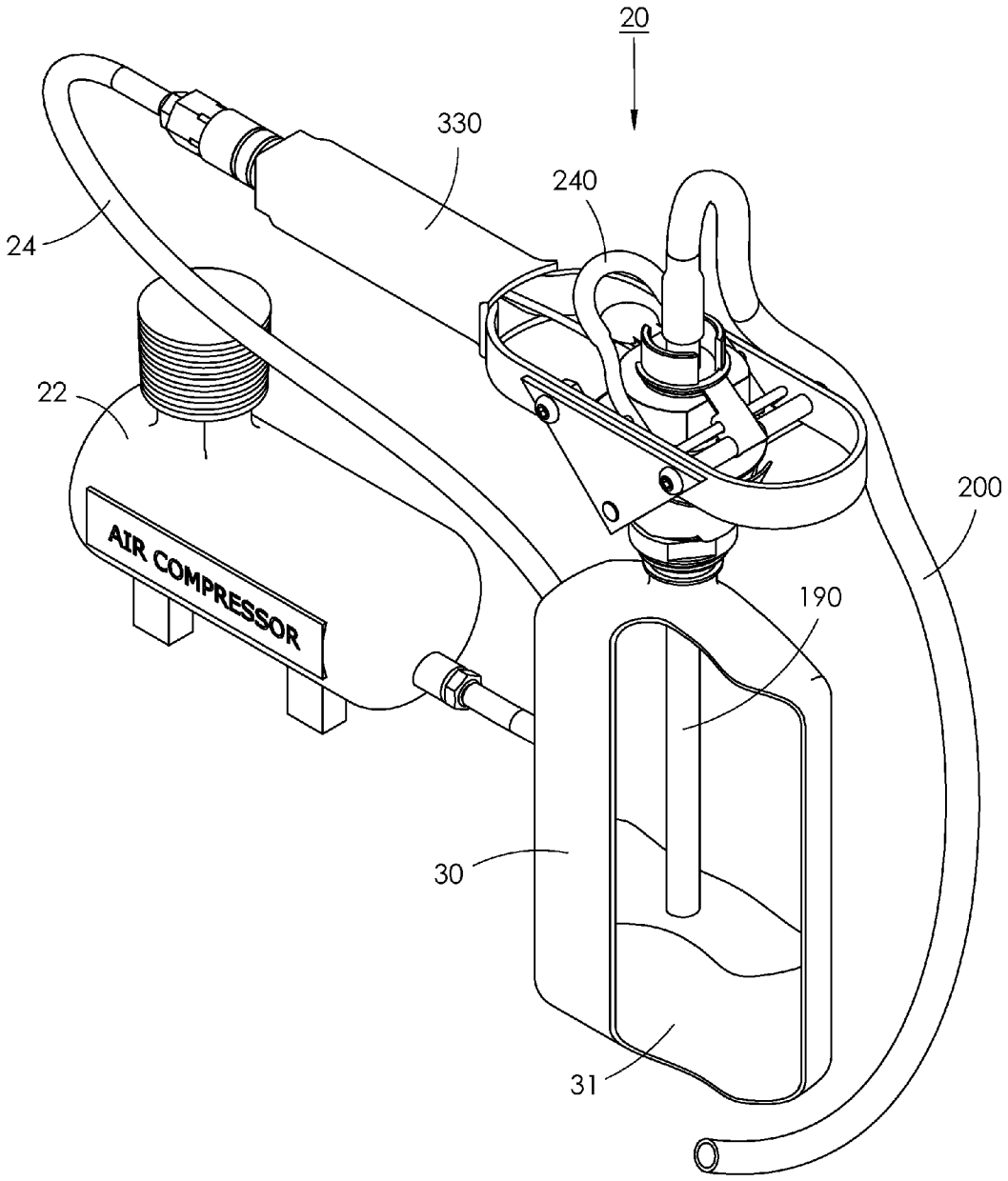
FIG. 1 is a perspective view of the apparatus connected to a container and an air pressure source.
Figure 2:
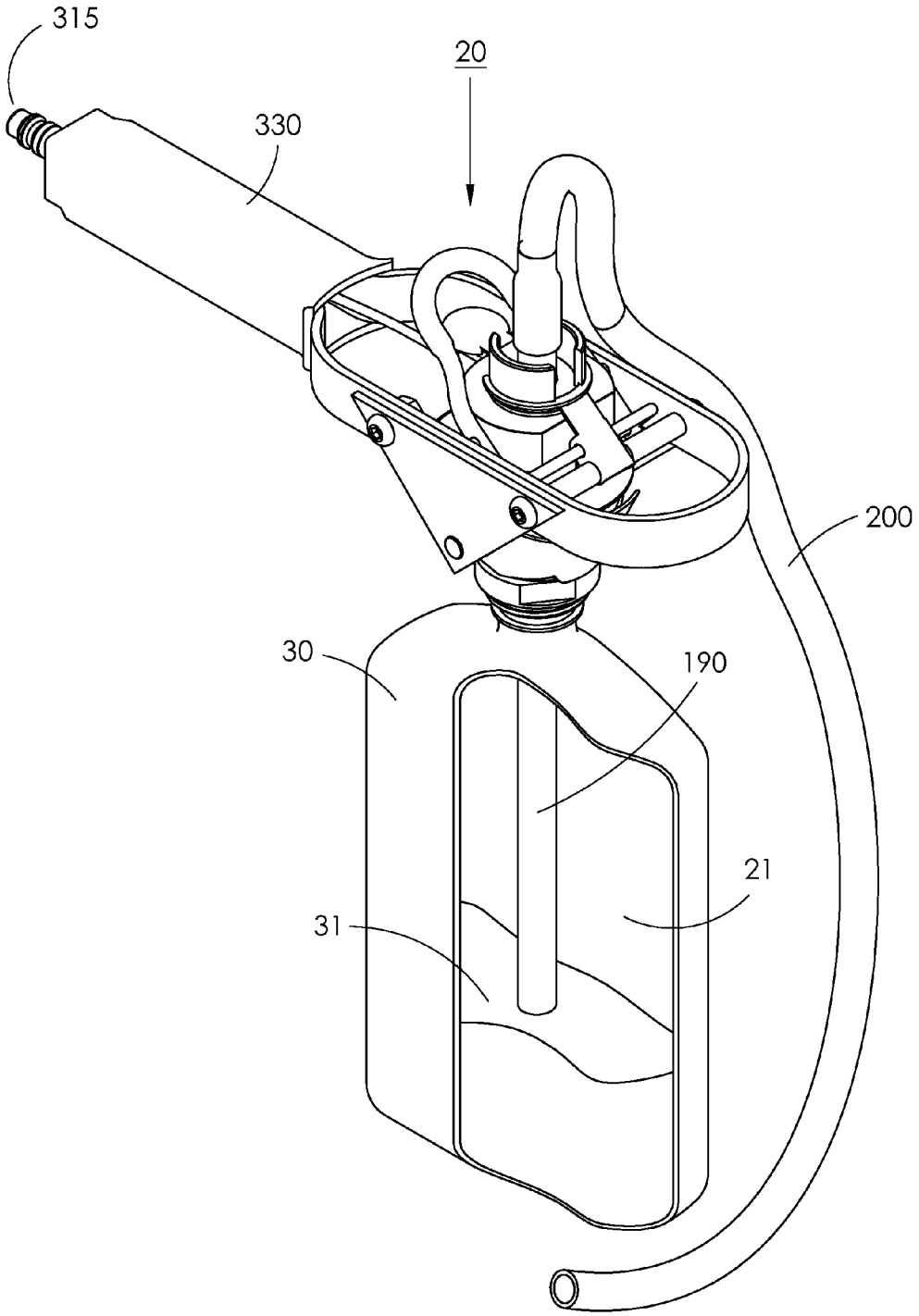
FIG. 2 is a perspective view of the apparatus connected to a container containing fluid.

Referring to the drawings, embodiments of the present device will be described below, wherein the illustrations are for the purpose of showing various embodiments of the device, and not for the purpose of limiting the same. FIG. 1 shows the apparatus 20 connected to a compressed air source 22. FIG. 2 shows a container 30 of fluid 31 connected to a hand controlled pneumatic powered fluid dispensing apparatus 20 uncoupled from supply hose 24 and the source 22 of compressed air or other gases.

Dispensing apparatus 20 shall be described with particular reference to the dispensing of viscous materials stored in a variety of containers with differently configured openings. Fluid 31 is dispensed from container 30 through vertically adjustable tube 190 and output hose 200.

Figure 3:
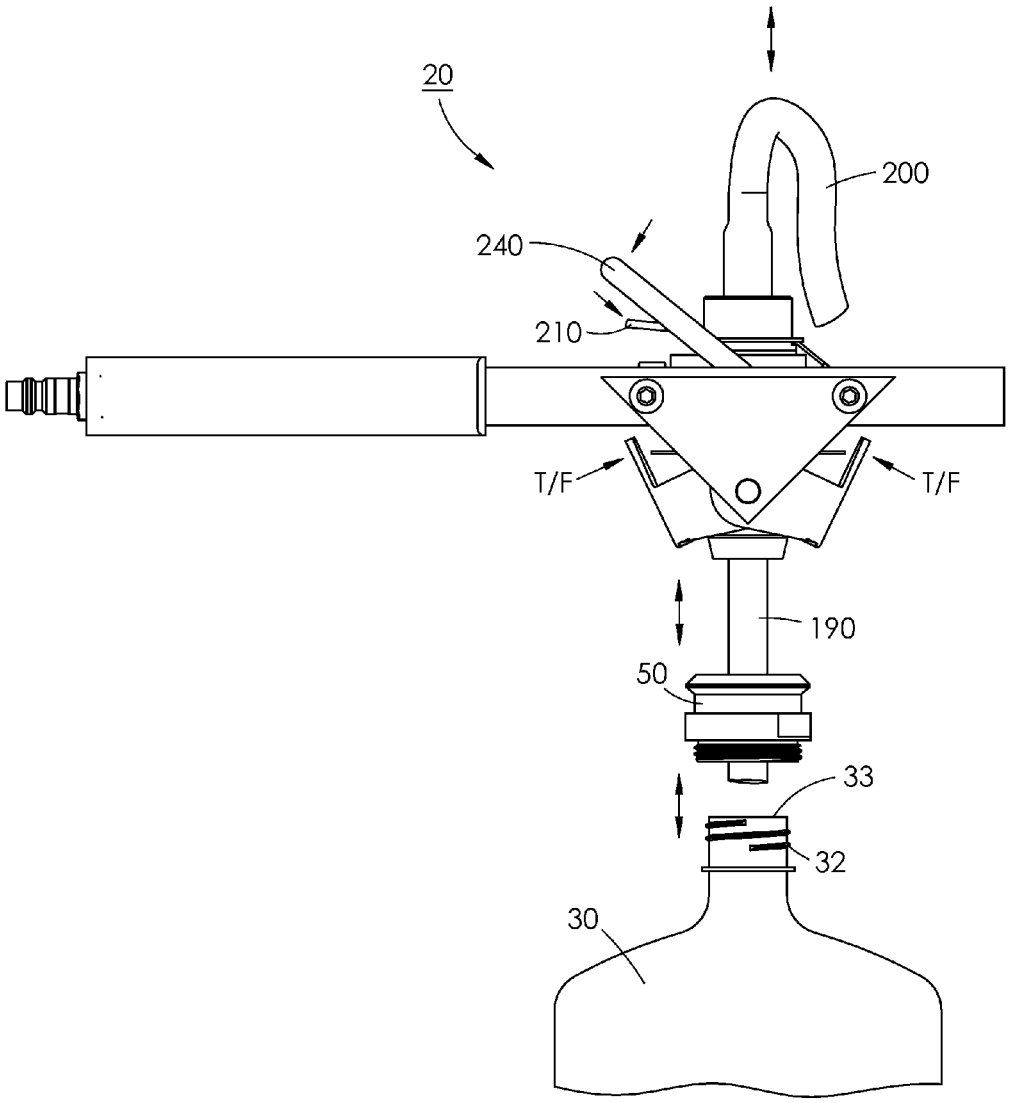
FIG. 3 is a right side view of the apparatus disconnected from the container and coupler/adapter.
Figure 4:
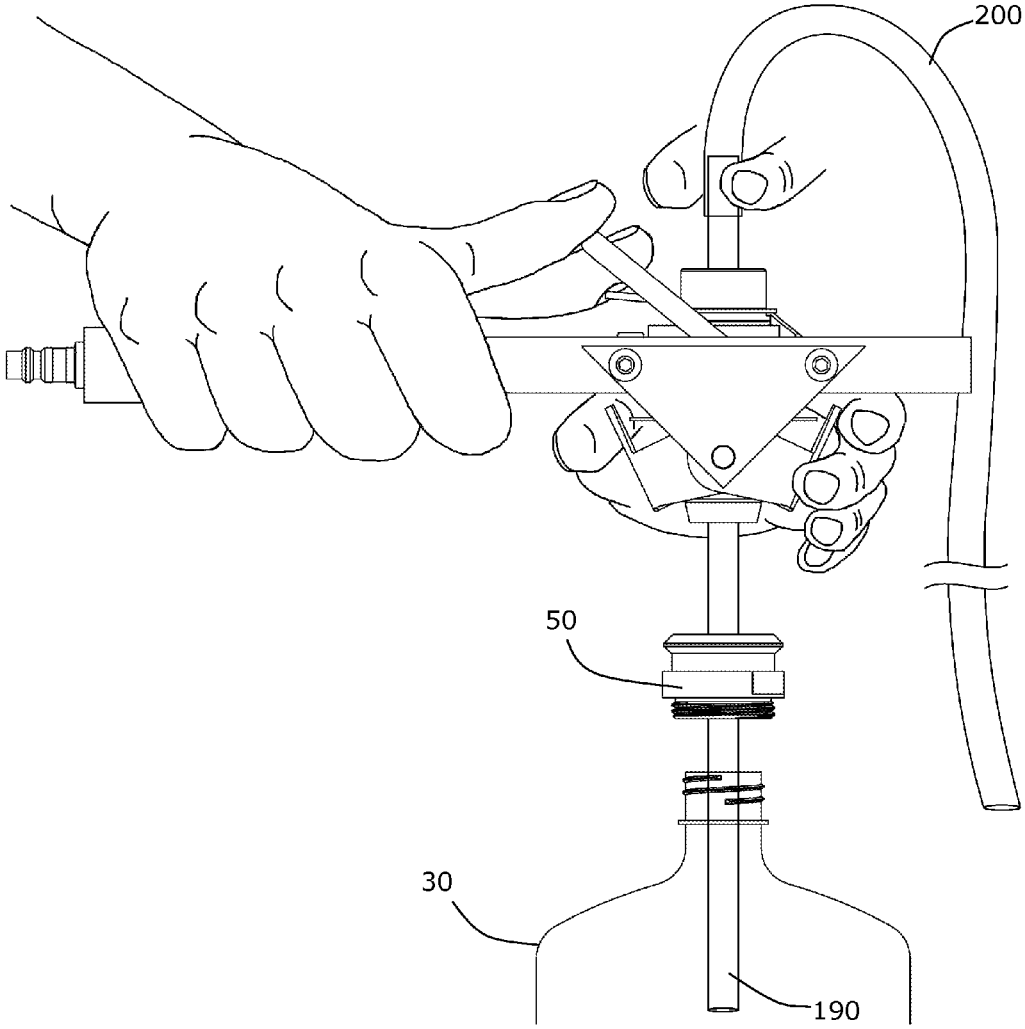
FIG. 4 is a right side view showing a thumb on the actuation lever (thumb upper position), a thumb on the tube release lever (thumb lower position), a vertical adjustment of the central discharge tube and a hand on the latches.
Figure 8:
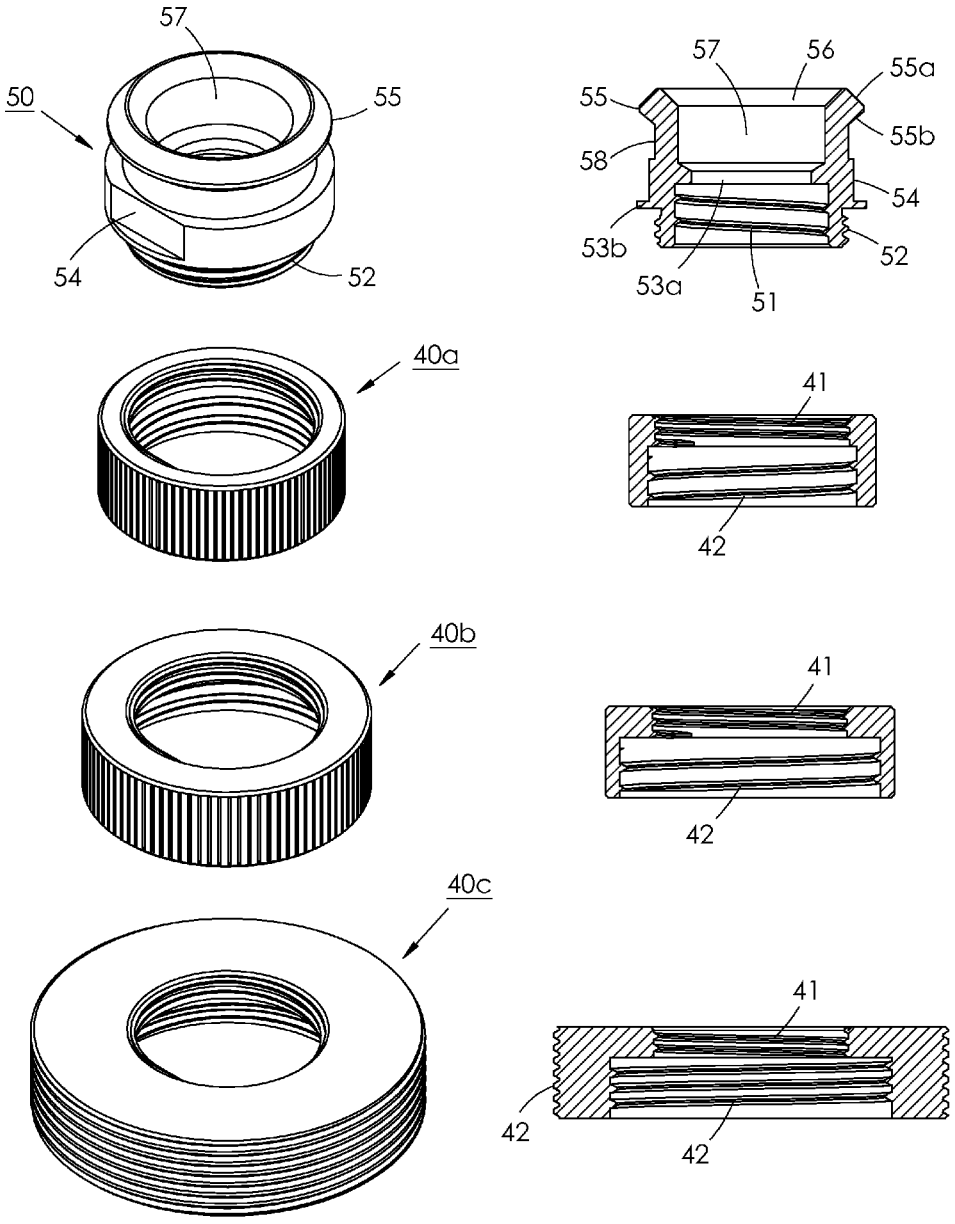
FIG. 8 is a perspective, and cross-section view of the coupler and adapters according to one embodiment of the apparatus.
Figure 9:
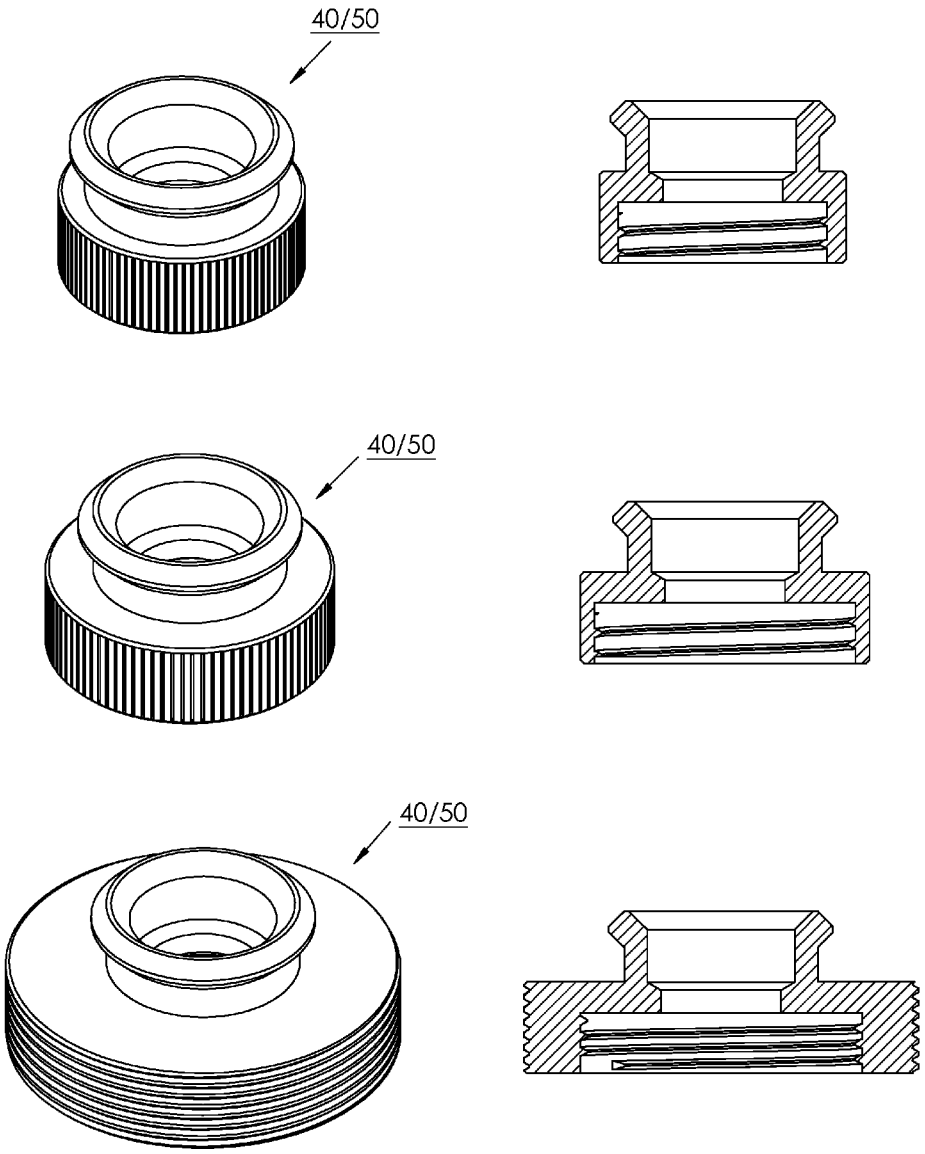
FIG. 9 is a perspective, and cross-section views of the adapter-couplers according to an alternative embodiment of the apparatus.

Apparatus 20 is configured to connect to a coupler 50 as seen in FIG. 3. Coupler 50 has a central bore that receives tube 190 and couples with valve body 70 with latches 60 and seals the apparatus 20 with the coupler 50 as shown in FIG. 4. The container 30 attaches to an adapter 40 that is typically configured with internal threads corresponding to outer threads of conventional container openings as illustrated in FIG. 8. In one embodiment, the coupler 50 and the adaptor 40 are one piece as illustrated in FIG. 9. As shown in FIG. 4, the apparatus 20 is mounted to container 30 for use by threading on an adaptor 40 and coupler 50 to the threads 32 of the container opening 33. The tube 190 of the apparatus 20 is inserted through the bore of coupler 50 and adaptor 40 to the interior of the container 30 and adjusted vertically to a desired depth in the fluid of container 30. The apparatus is seated and secured to coupler 50 with latches 60 in the embodiment shown.

One embodiment of coupler 50, as shown in FIG. 8, comprises a rigid cylindrical body constructed of aluminum, hard plastic, brass, composite materials, etc. Coupler 50 measures roughly 30 mm in length, having one end formed with internal threads 51 dimensioned to connect to a container threaded opening 32 (FIG. 3), and external threads 52 dimensioned to connect to a plurality of container adapters 40*a-c*. An internal 53*a* and also external 53*b* circumferential flange is formed starting 7 to 12 mm from this end, and is purposed as an abutment for the rim 33 of a container opening 32 (FIG. 3), and for the container adapters 40*a-c*. The outer flange is formed with two flats 54 spaced 180 degrees apart for the engagement of an open end wrench. Coupler 50 is formed at the opposite end with a triangular shaped outer flange 55 dimensionally configured to securely latch to quick connect and release latches 60. The major diameter of the triangular flange measures roughly 41 mm. The width of the flange at its base being roughly 6 to 7 mm. This end of the coupler 50 is also formed with a chamfer 56 at the inside diameter, having a slope and size similar to the adjacent slope of the triangular outer flange upper slope 55*a*. The slopes measure roughly 45 degrees, and the slope width measures roughly 4 mm. The triangular flange lower slope 55*b* measures roughly 50 degrees. The inside diameter 57 of the coupler 50 measures roughly 26 mm, and is dimensioned to seat and seal with 0-ring 80 of valve body 70. The outside diameter of the middle area 58 of the coupler measures roughly 34 to 35 mm.

FIG. 8 shows one embodiment of a plurality of container adapters 40*a-c*. One type of material that may be used for the adapter is plastic, an example of which includes acrylonitrile butadiene styrene (ABS). Other examples of materials that may also or otherwise be used include fiberglass, composite materials, metal alloys (particularly those that are lightweight for purposes of portability, although in some instances other heavier metal alloys may be used), and/or combinations thereof.

Each of a plurality of adapters 40*a-c* is formed with similar shape and dimensions 42 as the cap or plug of the container to which a person desires to connect to, and is dimensioned to connect to the container opening. All adapters are provided with a threaded cylindrical hole 41 dimensioned for threadedly attaching the adapter to the coupler external threads 52.

FIG. 9 shows another embodiment of adapter 40 and coupler 50 formed as one solid part 40/50. Forming the adapter and coupler together as one solid part, adapter-coupler 40/50, eliminates the need to change the coupler over to a different adapter when switching to a container with a differently configured opening. In this embodiment, the adapter-coupler 40/50 can be secured to different containers and remain on the container. The apparatus can be quickly coupled to adapter-coupler 40/50 for use.

Figure 10:
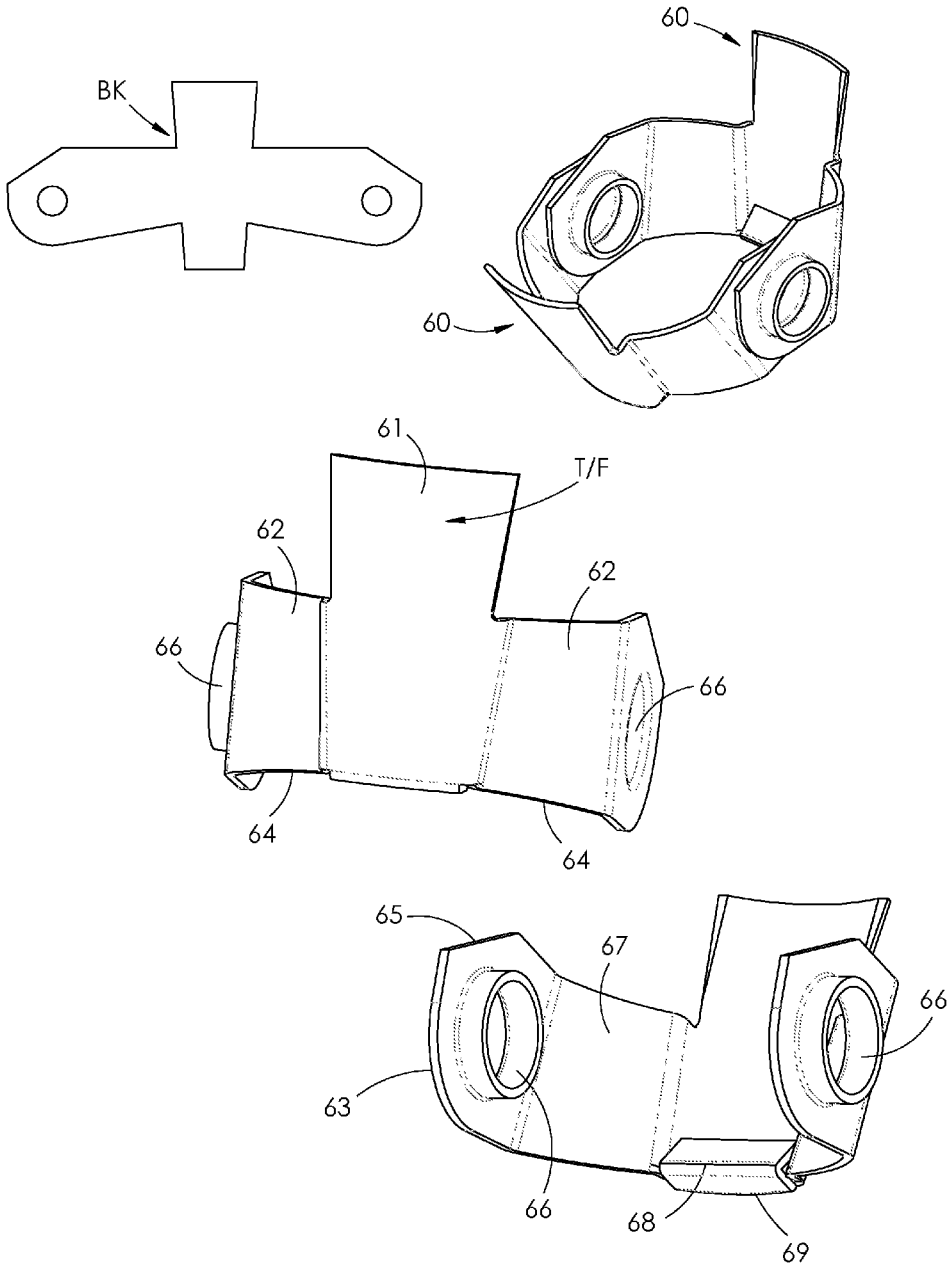
FIG. 10 is a perspective view of the latches, and also the latch blank.

FIG. 10 shows one embodiment of two identical latches 60. Latch 60 is typically formed by stamping methods which utilize progressive tooling. This preferred method of manufacture provides an inexpensive to manufacture part in large quantities. The latch starts out as a blank BK stamped from a roll of 1.0 mm to 1.5 mm thick formable sheet metal.

The vertical segment 61 of the blank measures roughly 50 mm long from top to bottom, and roughly 23 mm wide at the top, with the sides narrowing to roughly 16 mm wide at the bottom. The horizontal segment 62 of the blank is positioned so that about 18 mm of the vertical segment remains above the top edge of the horizontal segment. This section of the vertical segment provides a contact point for a thumb and index finger T/F to operate the latch.

The horizontal segment of the blank measures roughly 112 mm end to end, and roughly 27 mm wide. The lower ½ at each end has a radius 63 of roughly 12 mm, with the lower edge 64 then tapering up as it moves towards the center to roughly 20 mm in width where the edges meet the vertical segment. About 12 mm of the bottom of the vertical segment remains past this point. The top edge at each end of the of the horizontal segment is trimmed off diagonally, starting at about 16 mm in from each end, at an angle of 31-34 degrees to provide a cam type surface 65 for a spring assisted latch return washer 130.

A roughly 8 mm circular hole is punched out at each end of the horizontal segment. Both holes are equally spaced, and roughly centered in the 27 mm width of each end, with the hole spacing measuring roughly 87 mm to 88 mm from hole center to hole center. These two holes are then drawn to form a flanged round hole 66 roughly 13 mm in diameter, having a flange width of roughly 3 mm. The two flanges are formed in opposite directions of each other.

The two horizontal segments are then formed to make the blank into a "U" shape with a radius 67 of roughly 32 mm. The two ends straighten out for about the last 25 mm. The two ends now parallel each other, and measure roughly 47 mm to 48 mm across to each other. Also, both flanges now point in the same direction. These flanged holes are the latch pivot points, and communicate with the outside diameter of check valve outer housing 120.

The bottom of the vertical segment is formed with a 128 to 132 degree bend 68 upward, in the direction of the two flanged holes. The bend is located roughly 7 mm from the bottom edge of the vertical segment. A second 88 to 92 degree bend 69 is formed in the same direction, and is located roughly 5 mm from the first bend. These two bends are dimensionally configured to communicate with the triangular shaped outer flange 55 of coupler 50.

Figure 11:
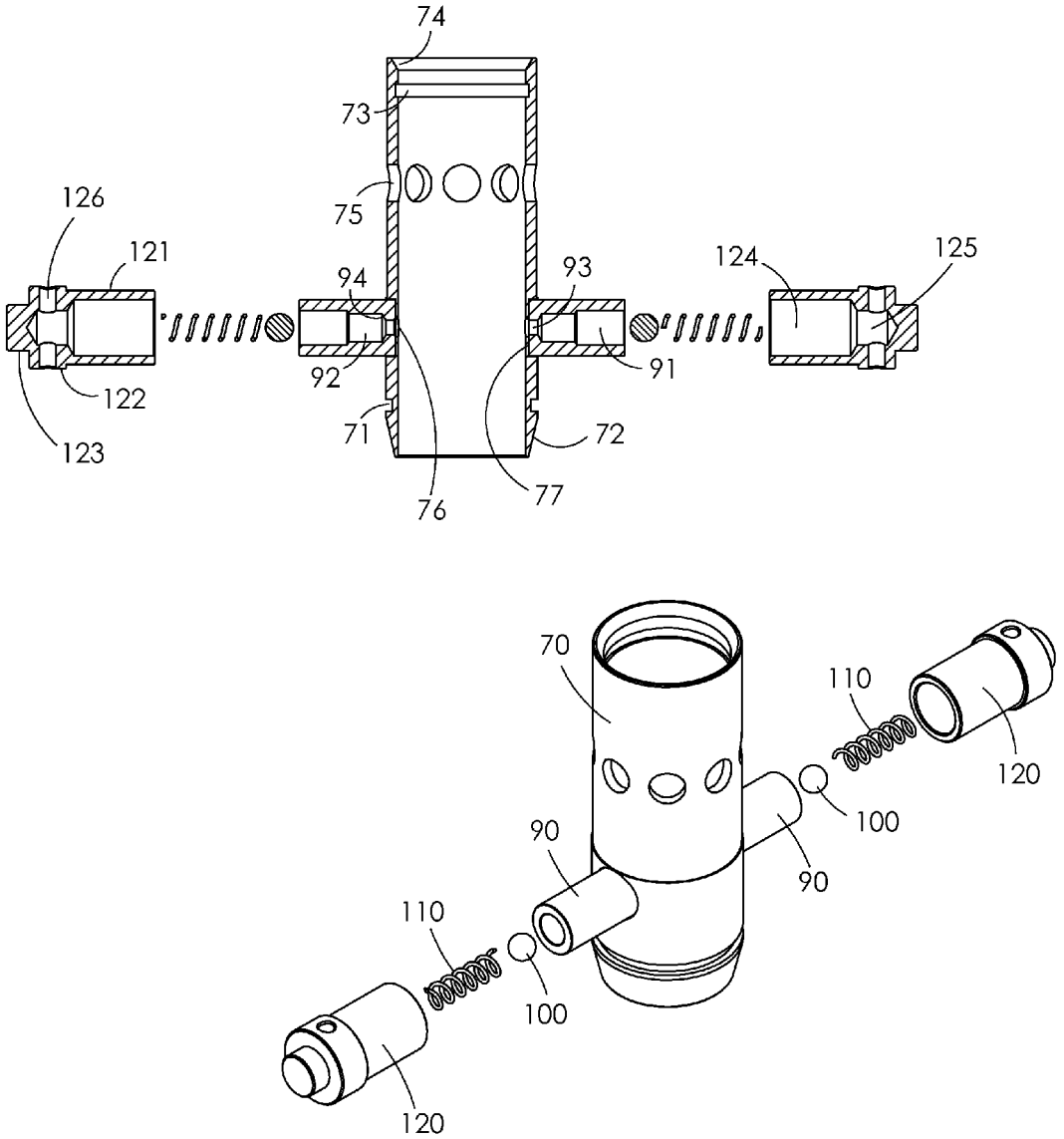
FIG. 11 is an exploded cross-section view, and a perspective view of the valve body and pressure relief valve assemblies.

FIG. 11 shows one embodiment of a cylindrical valve body 70. Valve body 70 is typically machined from metal alloy pipe or tubing. Manufacturing methods which use materials such as powdered metal, composites, etc, may also or otherwise be used, or a combination thereof.

The inside diameter of valve body 70 measures roughly 22 mm. The outside diameter measures roughly 26 mm. The length measures roughly 69 mm. One end has an o-ring groove 71 formed at the outside diameter centered roughly 9 mm from this end for placement of an o-ring 80 dimensioned to sealingly communicate with connector 50. This end also has a substantial chamfer 72 at the outside diameter. The opposite end of valve body 70 has a retaining ring groove 73 formed about 6 mm in from this end at the inside diameter, dimensionally configured to engage a retaining ring 160 of the tube guide bushing 150. The inside diameter also has a substantial chamfer 74 at this end to facilitate insertion of retaining ring 160, and also to provide space for guide bushing o-ring 170.

Centered about 22 mm in from this same end are eight evenly spaced circular holes 75 through the valve body sidewall measuring roughly 6 mm to 7 mm in diameter configured for gas inlet and outlet. Centered about 46 mm from this same end are two circular holes 76 spaced 180 degrees apart from each other, dimensionally configured for the attaching of two pressure relief valve inner housings 90. The area around these two holes is spot faced 77 to provide a flat contact surface for pressure relief valve inner housings 90.

FIG. 11 shows one embodiment with a pair of pressure relief valves positioned on opposite sides of valve body 70. Each pressure relief valve has a cylindrical pressure relief valve inner housing 90 and an outer housing 120. Pressure relief valve inner housing 90 is typically constructed of steel alloys. The outside diameter measures roughly 9.5 mm, and the length measures roughly 16.5 mm.

Each housing 90 has a three step round central bore that is open to the interior of valve body 70. The first step bore 91 measures 5.7 mm in diameter, and 8.2 mm deep from one end. This first step bore is configured to house a spring 110. The second step bore 92 measures 5.03 mm to 5.06 mm in diameter, and has a depth of 14.2 mm from the same end. This second bore is dimensionally configured for a loose fit of a ball 100. The third step bore 93 measures 2.5 mm to 2.6 mm in diameter, and goes all the way through the other end. The step at the intersection of bore 92 and 93 is dimensionally configured to act as a seat 94 for ball 100.

Two of these housings are attached to the two valve body circular holes 76 at the small bore end of the housing. The housings are attached by a press fit, resistance welded, or friction welded, or the housing can be formed with a stepped outside diameter at the small bore end for insertion through a larger valve body hole 76, and then the end of the housing flared out at the inside of the valve body to retain the housings.

FIG. 11 shows one embodiment of a ball 100 having a diameter of 5 mm, and is configured to loosely fit inside housing 90. Ball 100 is dimensionally configured to act as a pneumatic pressure relief ball.

FIG. 11 shows a compression spring 110 dimensionally configured to hold ball 100 on seat 94. Spring 110 is dimensioned and calibrated to operate pressure relief ball 100 at predetermined pressures. Century Spring Corp. in California, USA, spring part number 11457 has performed well in testing for this purpose, although other spring configurations may be used instead.

FIG. 11 shows one embodiment of a cylindrical pressure relief valve outer housing 120. Pressure relief valve outer housing 120 is typically constructed of metal alloys. The outer housing measures 25 mm to 26 mm in length.

The outside diameter of this embodiment of the pressure relief valve outer housing 120 is three stepped. One end has a first step 121 with a diameter of 12.6 mm to 12.8 mm, and a length of 15.2 mm to 15.3 mm, and is dimensioned to fit easily in flanged hole 66 of latch 60 that is shown in FIG. 10. The second step 122 diameter of outer housing 120 measures 14 mm to 15 mm, has a length of 6.3 mm to 6.4 mm, and is located adjacent to the first step 121. Step 122 also has a cylindrical vent hole 126 that passes through the diameter, and intersects with bore 125 to form a gas vent passage for the pressure relief valve. The diameter of the vent hole measures roughly 2.8 mm. The third step 123 is located at the opposite end of the housing 120 as first step 121, has a diameter measuring 7.8 mm to 7.9 mm, and has a length of 3.7 mm to 3.8 mm. Step 123 is dimensionally configured to slip fit into hole 304 of mounting plate 300.

The internal round bore of outer housing 120 is two stepped. The first step bore 124 has an inside diameter that measures 9.53 mm to 9.58 mm, with a depth of 13.9 mm to 14 mm, and is dimensionally configured to slip over inner housing 90. The second step bore 125 has an inside diameter that measures 5.7 mm, with a total depth from the same end of the housing of roughly 20 mm. This bore does not break through the opposite end. This second step bore 125 is dimensionally configured to house spring 110. The depth of the second step bore 125 can be varied to change the compressed length of spring 110, thereby providing relief valve pressure calibration.

Figure 5:
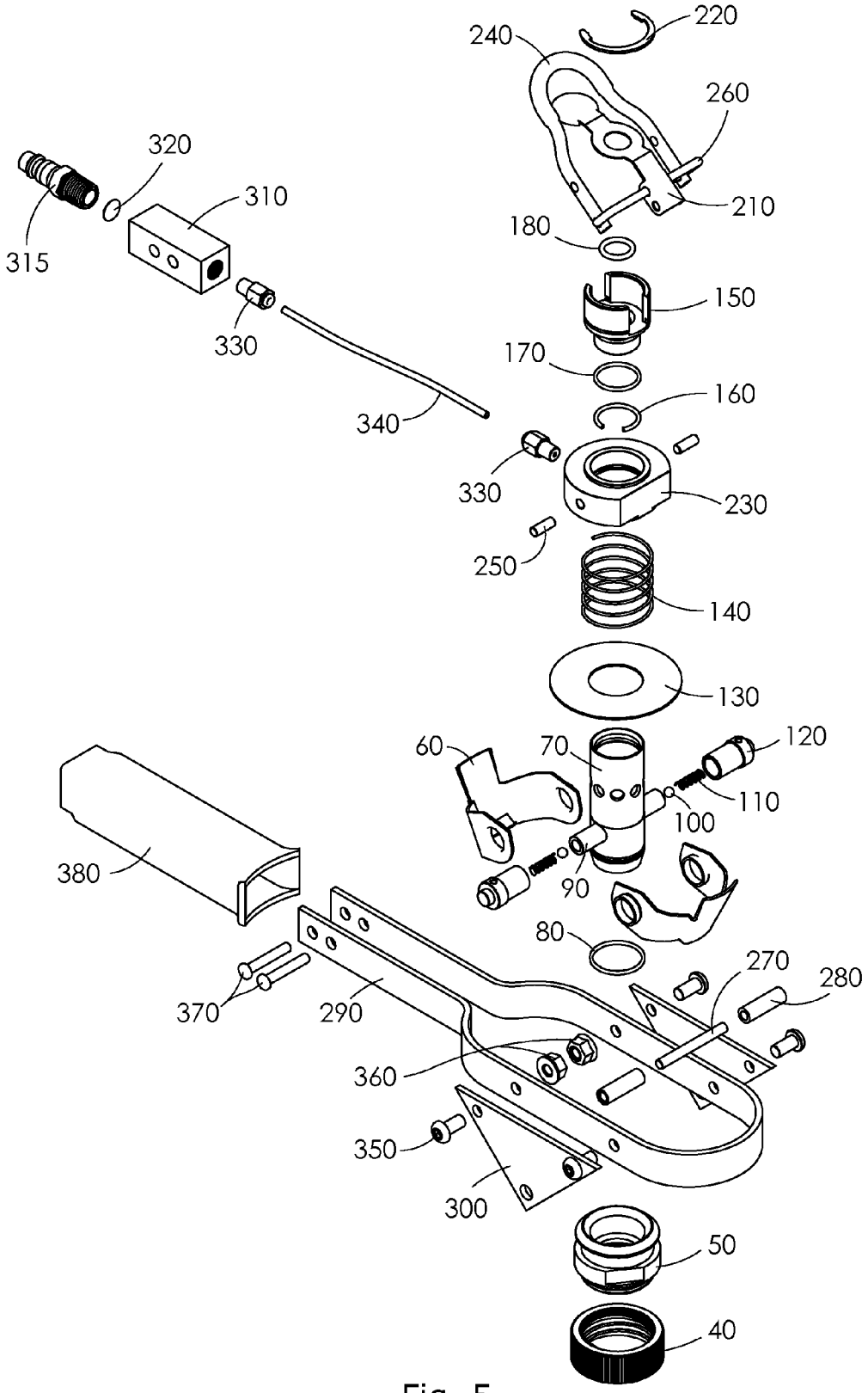
FIG. 5 is a perspective exploded view of the apparatus, fluid delivery tube not shown.
Figure 6:
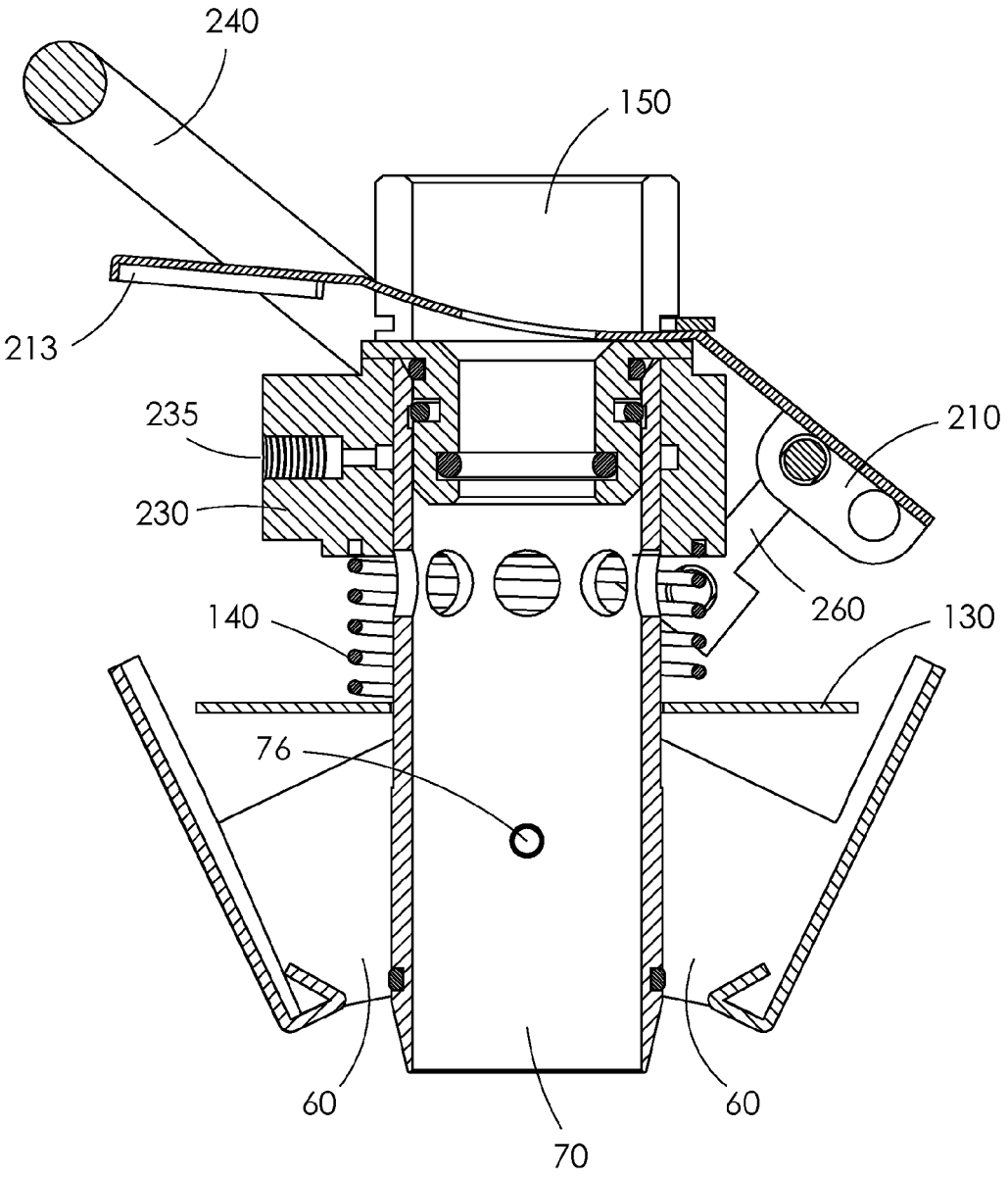
FIG. 6 is a right side view cross-section with some components omitted for clarity.
Figure 7:
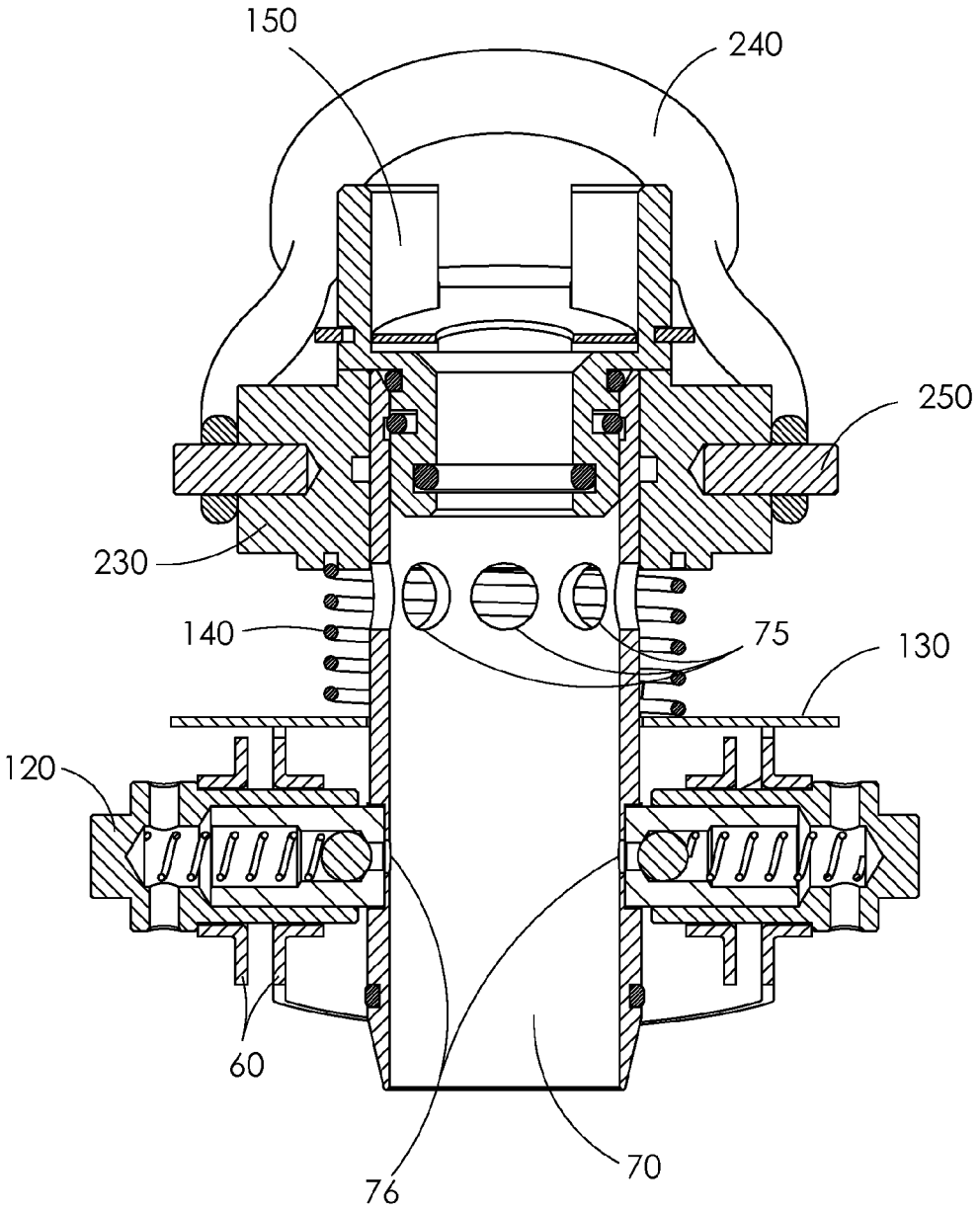
FIG. 7 is a front view cross-section with some components omitted for clarity.

The other valve components associated with the valve body 70 can be seen in FIG. 5, FIG. 6 and FIG. 7. Valve body 70 is disposed within the center opening 233 of valve 230 and valve 230 can move lengthwise along the outer surface of valve body 70. Movement of valve 230 is opposed by spring 140 and washer 130 that also encircle valve body 70. The valve 230 positioning along the outside of valve body 70 is also determined by the lever 240 and pivot linkage 260 with valve actuation by the movement of lever 240 as shown in FIG. 4.

FIGS. 5, 6, and 7 show one embodiment of the latch return washer 130. Washer 130 is typically constructed of a metal alloy. The inside diameter measures roughly 27 mm, the outside diameter roughly 63 mm, with a thickness of 0.5 mm to 1 mm. Washer 130 is positioned around valve body 70, and the underside of the washer communicates with cam surface 65 of latch 60 shown in FIG. 10. The top side of washer 130 communicates with the bottom of spring 140. Washer 130 is dimensionally configured to provide a contact surface communicating with cam 65 of each latch 60.

FIGS. 5, 6, and 7 show one embodiment of a compression spring 140. Spring 140 is dimensionally configured and calibrated to provide a force for latch 60 return, and a force for valve 230 return. Century Spring part number 3909 has performed well in testing for this purpose, although a wide range of spring configurations may be used instead.

Figure 12:
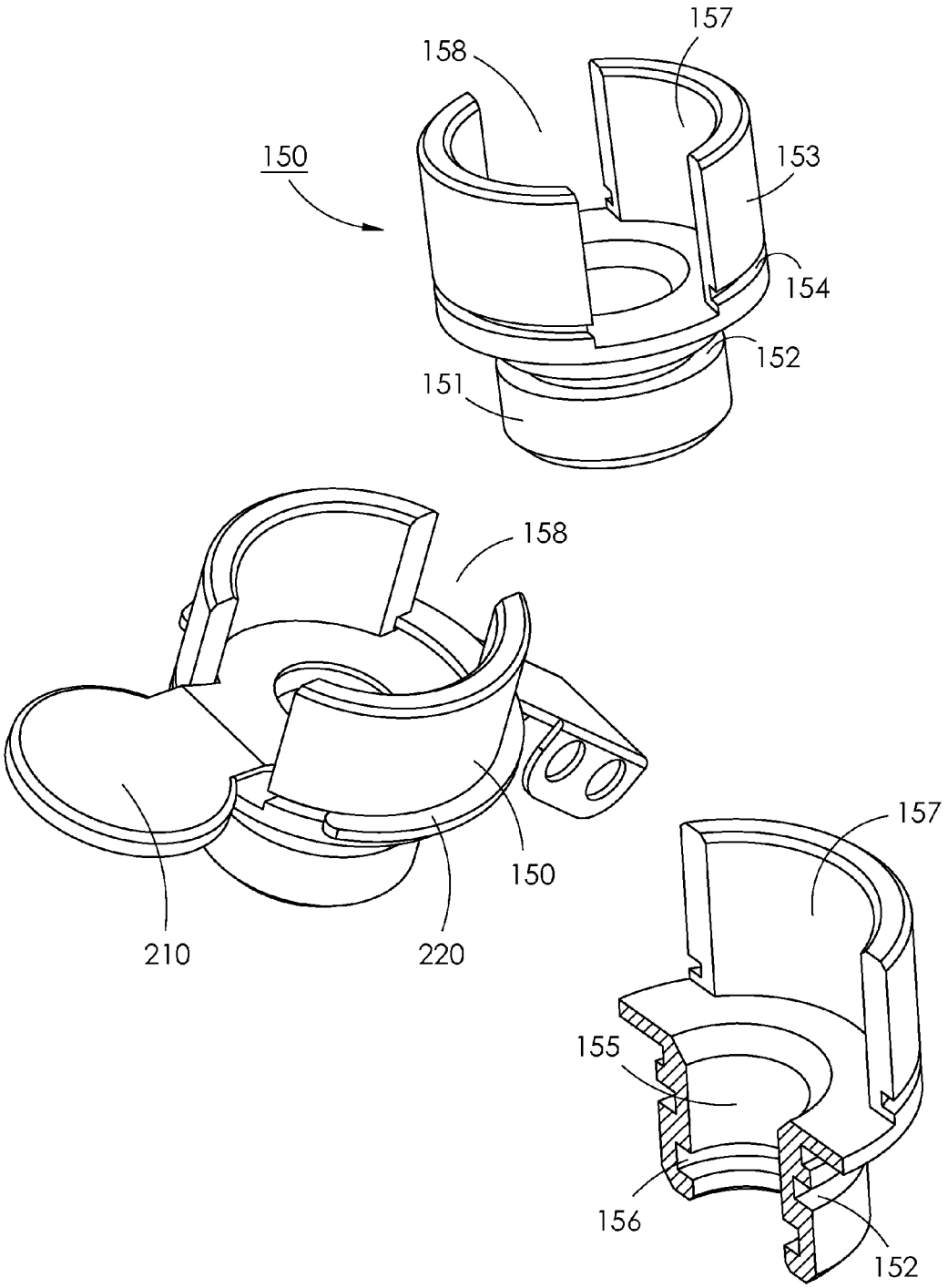
FIG. 12 is a perspective view, and cross-section view of the tube guide bushing with the tube release lever installed in the guide bushing.

FIG. 12 shows one embodiment of a cylindrical guide bushing 150 that is mounted in the top central opening and surface of valve 230. Bushing 150 comprises a rigid cylindrical body constructed of aluminum, hard plastic, brass, composite materials, etc. Bushing 150 measures roughly 32 mm in length, and has a two step outside diameter. The first smaller step 151 diameter is dimensionally configured to slip inside the bore of valve body 70. The first step diameter also has a groove 152 dimensionally configured for a round wire retaining ring 160, and is dimensionally configured to retain bushing 150 in valve body 70. Second step 153 of cylindrical guide bushing 150 has a larger diameter of roughly 32 mm. The length of step 153 measures roughly 18 mm. This step is also dimensionally configured with a groove 154 for a retaining ring 220, positioned about 13 mm from the top of the bushing 150.

A lip formed by step 151 and 153 is dimensionally configured to abut the top of valve body 70. This lip also provides a travel limit, or stop, for a valve 230. The inside diameter of bushing 150 is also two stepped.

The inside diameter of the first step bore 155 of bushing 150 measures roughly 13 mm, and is dimensionally configured for a 13 mm diameter metal fluid dispensing tube 190 to be easily inserted or removed. Bore 155 is also dimensionally configured with a groove 156 for an o-ring 180 to sealingly communicate with tube 190. The second step bore 157 inside diameter measures roughly 25.5 mm. This bore has a depth of roughly 15 mm from the top of bushing 150.

The top of bushing 150 has a rectangular slot 158 formed and centered across the top measuring roughly 13 mm wide and 15 mm deep. Slot 158, along with bore 157 and retaining ring 220, are dimensionally configured for the placement and retention of lever 210.

FIGS. 5, 6, and 7 show a round wire open-end retaining ring 160 dimensionally configured to communicate with groove 73 of valve body 70 and groove 152 of bushing 150, and is dimensionally configured to retain bushing 150 in valve body 70.

FIGS. 5, 6, and 7 show an o-ring 180 dimensionally configured to sealingly communicate with fluid dispensing tube 190 in guide bushing 150.

FIG. 2 shows a metal fluid dispensing tube 190 measuring roughly 13 mm in diameter, with a length long enough to communicate with the fluid 31 of container 30, typically around 50 cm. Tube 190 fits through bushing 150, and communicates with the fluid 31 of container 30.

FIG. 2 shows a fluid dispensing tube extension hose 200 dimensionally configured to fit over the external end of tube 190. The extension hose 200 material is typically flexible, and compatible with the types of fluids being dispensed, with a length varying according to a user's needs.

FIG. 13*a*, and also FIGS. 3, 5, 6, and 12 show one embodiment of a fluid dispensing tube release lever 210 that is typically formed from a spring steel sheet of roughly 0.7 mm to 0.8 mm in thickness. Lever 210 from a top view appears roughly rectangular in shape and measures roughly 12.8 mm wide by 88 mm long.

One end of tube release lever 210 is formed into a channel 211 measuring roughly 13 mm wide and 18 mm in length, with the sides of the channel measuring roughly 8 mm in height. Each side has two circular holes evenly spaced measuring roughly 4.8 mm in diameter, with the hole center to hole center measuring roughly 8.6 mm. The first hole 212*a* is dimensionally configured for insertion of anchor pin 270. Second hole 212*b* is dimensionally configured for insertion of lever pivot linkage 260. The opposite end 213 of lever 210 is rounded with a rolled down edge, has a diameter of about 23 mm, and provides a surface for the placement of a thumb or finger in order to push on the lever, thereby releasing the grip of the lever on tube 190.

Centered roughly 20 mm from the channeled end is a bulbous circular section 214 that has a radius of roughly 12.5 mm, and is dimensionally configured to fit easily inside bore 157 of bushing 150. A round hole 215, measuring roughly 13.2 mm in diameter, is centered in circular section 214 of tube release lever 210. Hole 215 is dimensionally configured to grip the sides of tube 190 when lever 210 is tensioned at an angle around tube 190. The static angle of section 214 in relation to channel 211 measures roughly 25 degrees. Lever 210 is also dimensionally configured to maintain the positioning of the top of the main valve body 70.

FIG. 12 shows a retaining ring 220 consisting of a rectangular cross-section, and is open-ended. Retaining ring 220 is dimensionally configured to communicate with groove 154 of bushing 150. Retaining ring 220 is dimensionally configured and positioned to retain lever 210 in bushing 150.

FIG. 14, and FIGS. 5, 6, and 7 show one embodiment of a pneumatic valve 230. Valve 230 comprises a rigid cylindrical shaped body constructed of aluminum, hard plastic, brass, steel, composite materials, etc. The outside diameter 231 of valve 230 measures roughly 50 mm. The outside diameter is also formed with a "D" shaped flat 232 to provide clearance for channel 211 of lever 210.

The inside diameter 233 of valve 230 shown in FIG. 14 measures roughly 26 mm, and slidably communicates with the outside diameter of valve body 70. The clearance between valve 230 and valve body 70 is in a range of 0.02 to 0.04 mm. The inside diameter 233 is also configured with a square cut annulus 234 that is circumferentially placed, and centered in the width, measuring roughly 1.7 mm square.

The thickness of valve 230 measures roughly 19 mm. The underside face 238 of valve 230 is configured with a circumferential shallow groove 239 that is dimensioned to communicate with the top of spring 140. Groove 239 provides a spring seat to keep spring 140 centered.

A cylindrical threaded bore 235 is configured for installation of fitting 330, and is located 180 degrees opposite of flat 232. Threaded bore 235 does not break through to annulus 234. Another cylindrical hole 236 centered at bore 235, having a diameter of 1.5 mm to 1.6 mm in one embodiment, does break through, and does communicate with groove 234. Hole 236 is dimensionally configured to provide an orifice type restriction to the inlet air flow to groove 234.

Two cylindrical bores 237 are located at the outside diameter of valve 230, are spaced 180 degrees apart, and are perpendicular with flat 232. Bores 237 are dimensionally configured for installation of two lever connecting pins 250. The bores have a diameter of 5 mm, and a depth of 6 mm.

FIG. 13*c* shows one embodiment of an actuation lever 240. Lever 240 in this embodiment is formed from metal tubing with a diameter of roughly 8 mm, and roughly 1.6 mm wall thickness. Other materials may also or otherwise be used, such as molded plastic, etc. Lever 240 is somewhat "U" shaped. The form of lever 240 is dimensionally configured to fit inside frame 290, operate valve 230, and communicate with lever pivot linkage 260.

The sides 241 of lever 240 are flattened, and also have two round holes in each side. All holes have a diameter of roughly 5.2 mm. The holes 242*a* closest to each end are dimensionally configured to communicate with lever pivot linkage 260, and the holes 242*b* are located roughly 20 mm inboard from holes 242*a* being dimensionally configured to communicate with connecting pin 250.

The radius of the "U" 243 measures roughly 21 mm to the outside of the tube, and is dimensionally configured for placement of a thumb to push on, to cause valve 230 to move.

FIGS. 5 and 7 show a connecting pin 250. Pin 250 is typically a solid dowel pin measuring roughly 13 mm long and 5 mm in diameter in this embodiment. Pins of other materials and configurations, such as hollow split, etc., may also or otherwise be used. Pin 250 is dimensionally configured to pivotally connect lever 240 to valve 230.

FIG. 13*b* shows one embodiment of a lever pivot linkage 260. Linkage 260 is formed from roughly 4 mm diameter solid metal wire. Linkage 260 is formed in a rectangular shape measuring roughly 63 mm by 21 mm measured from the outside.

Both ends 261 of the wire face each other. The ends terminate within one of the long sides, and are equally spaced measuring roughly 5 mm long from the corners 262. The ends 261 are dimensionally configured to pivotally communicate with holes 242*a* of lever 240. The opposite long side 263, at about the middle, is dimensionally configured to pivotally communicate with holes 212*b* of lever 210.

FIG. 13*c* shows an anchor pin 270. Pin 270 is typically a solid dowel pin measuring roughly 45 mm in length, and has a diameter of roughly 5 mm. Pin 270 is dimensionally configured to communicate with holes 212*a* of lever 210, and also the bores of posts 280. Pin 270 is also dimensionally configured to maintain positioning of lever 210.

FIG. 16*c* shows a mounting post 280. Post 280 is typically a metal tube of an easily machinable material such as brass or aluminum. Post 280 has an outside diameter measuring roughly 8 mm, the inside diameter 5 mm, and a length of 25 mm.

The bore at one end is threaded, and communicates with side plate mounting bolt 350 (FIGS. 5 and 16*c*). This end of post 280 also abuts the inside surface of frame 290. The bore at the other end of post 280 communicates with anchor pin 270. This end of post 280 also abuts channel hole 212*a* of lever 210. Post 280 is dimensionally configured to enclose the ends and maintain the position of pin 270, maintain the position of lever 240, and maintain positioning of the valve body mounting plates 300 to handle 290.

FIGS. 16*a-c* and FIG. 5 show one embodiment of a handle 290. Handle 290 is typically formed from an aluminum flat bar measuring roughly 3 mm thick, 19 mm wide, and 60 cm in length. Handle 290 is formed somewhat oval in shape 291 and measures roughly 7.1 cm by 17 cm at the outside.

About 10 cm of each end of the flat bar turn out, and extend away from one corner 292 of the oval, forming a hand grip 293. The ends forming the grip are straight at this section, are parallel to each other, and are spaced roughly 25 mm apart measured from the outside. Grip 293 is parallel with and centered in relation to the sides of the oval. Each end of grip 293 has two circular holes 294 roughly 6 mm in diameter, dimensionally configured for pneumatic connector mounting rivets 370.

Each side of the oval shape 291 has two circular holes 295 roughly 6 mm in diameter that are spaced roughly 6.6 cm center to center, and are spaced evenly within the oval shape 291. Holes 295 are dimensionally configured for attachment of mounting plates 300 to handle 290. Handle 290 is dimensionally configured to provide a hand graspable section 293, and has attachment points for pneumatic connector 310, mounting plates 300, and posts 280.

FIGS. 16*b* and 5 show one embodiment of two identical valve body mounting plates 300. Plate 300 is typically stamped out of roughly 1.2 mm thick aluminum into a triangular shape. Other metals or materials, such as composites, molded plastics, etc., may also or otherwise be used. The top edge 301 measures roughly 9.5 cm, and each side 302 measures roughly 6.8 cm in length.

There are two round holes 303 roughly 6 mm in diameter centered roughly 6 mm from the top edge spaced roughly 6.6 cm center to center. These holes are dimensionally configured to communicate with the mounting plates to handle mounting bolts 350. One round hole 304 is located at the bottom measuring roughly 8 mm in diameter, and is centered at the bottom of the triangle roughly 3.76 cm from top edge 301. Hole 304 is dimensionally configured to communicate with step 123 of housing 120.

FIG. 15 shows one embodiment of a pneumatic connector 310. Connector 310 is typically formed from 19 mm square solid aluminum bar. Other metals, or materials, such as composites, molded plastics, etc., may also or otherwise be used. The length of connector 310 measures roughly 50 mm.

Connector 310 has a 3 step cylindrical bore. The first step bore 311 measures roughly 11 mm in diameter by roughly 14 mm deep, and is threadedly configured for communication with an inlet air supply line connection 315 (FIG. 5). The second step bore 312 measures roughly 10 mm in diameter, and has a depth of roughly 44 mm from the same end. The third step bore 313 measures roughly 6.3 mm, breaks through the opposite end, and is threadedly configured for communication with a quick connect fitting 330 at the opposite end. The step formed at the intersection of bore 311 and 312 is dimensionally configured to communicate with an inlet air filter disc screen 320 (FIGS. 15 and 5).

The side of connector 310 has two cylindrical through-holes 314 roughly 5 mm in diameter, spaced roughly 13 mm center to center, with one centered roughly 25 mm from the first bore 311 end. Holes 314 are dimensionally configured to communicate with handle holes 294 and mounting rivets 370.

FIGS. 5 and 15 show one embodiment of a disc screen filter 320. Filter 320 is circular, and is typically made from sintered stainless steel flat screen measuring roughly 11 mm in diameter, and dimensionally configured to press fit into bore 311 of connector 310. Other materials such as sintered bronze, porous, or sintered plastics, plastic screen, etc., may also or otherwise be used for inlet air supply filter 320.

FIG. 5 shows one embodiment of a quick connect tubing fitting 330. Fitting 330 has a 1/16 NPT male threaded end dimensionally configured to communicate with bore 313 of connector 310, and also bore 235 of valve 230. The opposite end of fitting 330 has a quick coupling for insertion of air supply tube 340. The fitting used in this embodiment is part number KQ2H01-33, from SMC Corporation of America located in Anaheim Calif., USA. Other sizes and types of fittings may also or otherwise be used.

FIG. 5 shows an air supply tubing 340. Tubing 340 is typically standard nylon air line tubing. The outside diameter is 3.18 mm, and roughly 13 cm in length. Tubing 340 is dimensionally configured to communicate with fittings 330 of connector 310 and valve 230. Other sizes and types of tubing may also or otherwise be used.

FIG. 5 shows a bolt 350. Bolt 350 is typically a 6 mm diameter by 13 mm long button head bolt. Bolt 350 is dimensionally configured to attach plate 300 and post 280 to handle 290. Other types and sizes of fasteners may also or otherwise be used.

FIG. 5 shows a nut 360. Nut 360 is typically a flanged 6 mm hex nut. Nut 360 is dimensionally configured to communicate with the two bolts 350 that are closest to the hand grip end of handle 290. Other types and sizes of fasteners may also or otherwise be used.

FIG. 5 shows a rivet 370. Rivet 370 is typically a semi-tubular oval head metal rivet dimensionally configured to communicate with holes 294 of handle 290, and with holes 314 of connector 310.

FIG. 5 shows one embodiment of a cover 380. Cover 380 is typically a rubber material formed in a tubular shape with an inside diameter of roughly a 25 mm, and a length of roughly 10 cm. Cover 380 is dimensionally configured to communicate tightly over section 293 of handle 290, and for gripping by a human hand. Various types of rubber or other materials may also or otherwise be used.

Operation

The manner of using the fluid dispensing apparatus is unique to fluid dispensers and is generally illustrated in FIGS. 3, 4, 17 and 18. One first obtains a container of fluid/liquid that one wishes to dispense. The cap is removed from the container, and one selects from a plurality of adapters 40*a-c* (FIGS. 8, 9), an adapter that is compatible to sealingly connect to the container opening. Then, coupler 50 is screwed onto the adapter 40, and both are connected to the container.

Next, a pressurized air source is connected to fluid dispensing apparatus 20, normally using an air hose with a common quick-connect coupler. Now the fluid dispensing apparatus 20 is ready to be connected to the container. While holding the apparatus with one hand by the apparatus handle 290, one inserts the bottom of tube 190 through coupler 50, and then clicks the apparatus 20 down on top of coupler 50 with latches 60, in order for the apparatus to securely latch onto coupler 50. One does not need to manipulate the latches by hand to accomplish this. The latches only need to be squeezed together by a thumb and index finger at T/F points when one wishes to disconnect the apparatus from the coupler/container. The thumb and index finger can be seen on the latches in FIG. 4. Only a very light amount of effort is required to squeeze the latches. For example, far less effort than it takes to squeeze a common clothes pin.

The next step is to adjust tube 190 vertically to reach the bottom of the container. This is done simply by pushing down on the top of tube 190 by hand. To pull up or remove tube 190, one must first push down with a thumb or finger on section 213 of tube release lever 210 (FIG. 13*a*). This releases the grip of lever 210 on tube 190, so that tube 190 can be pulled up, or removed from apparatus 20.

Normal holding of the apparatus 20 by the hand grip presents the thumb in the proper orientation for, and comfortably fits under radius 243 of valve actuation lever 240, in order to push on section 213 of lever 210. FIG. 4 shows a thumb on tube release lever 210 (lower thumb).

Fluid dispensing apparatus 20 is now ready to dispense fluid. Valve 230 actuation occurs by positioning the air inlet 235 and interior groove 234 of valve 230 over the holes 75 of the valve body 70 as shown in FIG. 17. The same thumb is also in proper orientation for, and easily pushes down on radius 243 of actuation lever 240. FIG. 4 shows a thumb on lever 240 (upper thumb). This causes lever 240 to move down. Pushing down on lever 240 positions annulus 234 of valve 230 in alignment with holes 75 of valve body 70. This provides a path for air pressure 21 to enter the container as shown in FIG. 17. This pressurizes the interior of the container, which causes the fluid in the container to flow out of the container through tube 190 and hose 200.

The volume of air used for dispensing is automatically limited by orifice 236 of valve 230. The air pressure 21 inside the container is automatically limited to a predetermined pressure by the air pressure relief valves, which consist of parts 90, 100, 110, and 120. When air pressure builds inside the container, the pressure acts on ball 100. Ball 100 is held closed, resting on its seat 94 from the tension of spring 110. When the air pressure acting on the ball overcomes the tension of spring 110, ball 100 is moved off of its seat. Any excess pressure 21 flows around ball 100, and exits through the vent holes 126 of housing 120, as illustrated in FIG. 18. During testing the apparatus satisfactorily dispensed highly viscous fluids from many thin-walled plastic containers without damage to the container, when the pressure relief valve was calibrated to limit the internal container pressure to 1 bar.

Orifice 236 of valve 230 is dimensionally configured large enough so that there is preferably a minimal amount of pneumatic pressure 21 continually being exhausted through the pressure relief valves during dispensing. This is to assure that there is always an ample amount of air pressure available for fluid dispensing. Another benefit of air pressure continually exhausting through the relief valves during each dispensing cycle is that it helps to prevent the valves from becoming stuck in the closed position from non-use. An additional advantage of having an air pressure reserve available is to compensate for air leakage of the entire system, such as a leaking connection of the adapter to the container due to a deformed opening of the plastic container.

To stop the fluid dispensing, one simply takes their thumb off lever 240. This action causes spring 140 to return valve 230 to its at-rest position adjacent to holes 75 of valve body 70. This exposes the holes 75 of valve body 70 to the atmosphere. This vents the air pressure 21 inside the container, which equalizes the air pressure inside the container to the air pressure outside of the container, thereby causing the fluid in the container to cease dispensing. This is best illustrated in FIG. 18.

Fluid dispensing apparatus 20 can be transported with the container attached to the point of use simply by carrying it with one hand on handle 290. Apparatus 20 stays latched to a container very well. I have tried unsuccessfully to violently shake loose a 5-liter container of liquid attached to the dispensing apparatus.

Additional Embodiment FIG. 20

FIG. 20 shows an additional embodiment of the fluid dispensing apparatus 20*z* with an alternative embodiment of the coupler illustrated in FIG. 19. This embodiment is similar to the first embodiment except that the latches 60 are absent, and coupler 50 of FIG. 8 is redesigned to connect to apparatus 20*z* without the latches. Coupler 50*z* has a pair of hooked fingers 390, 392 on the top of the coupler body that similar to a bayonet type of mounting scheme. The bottom of the coupler 50*z* has threads 52 that allow the coupler to be fixed to an adapter 40 in the embodiment shown in FIG. 19. The opposing pressure relief valves that extend radially from the valve body 70 are engaged by the hooked fingers 390, 392 of coupler 50*z* to secure the valve body 70 to the coupler 50*z*. This coupler 50*z* (FIG. 19) connects to apparatus 20*z* by pushing the apparatus down onto the coupler 50*z*, and then rotating the apparatus ¼ turn to lock the apparatus to the coupler. Coupler 50*z* connects to the pressure relief valve outside diameter step 121 of the pressure relief valve outer housing 120, where the latches 60 would pivot in the first embodiment. Spring 140 and washer 130 provide tension to assist in keeping the apparatus locked to the coupler. To disconnect the apparatus from the coupler, one simply pushes down on apparatus 20*z*, and rotates the apparatus ¼ turn in the opposite direction, then lifts the apparatus up and off of coupler 50*z*. The rest of the operation of apparatus 20*z* is essentially the same as fluid dispensing apparatus 20 of the first embodiment described previously.

Alternative Embodiment of FIG. 22

FIG. 21, FIG. 22 and FIG. 23 shows an alternative embodiment of the fluid dispensing apparatus 20*zz* which eliminates several components of the first embodiment, such as latch 60, lever 240, pin 250, linkage 260, pin 270, post 280, handle 290, plate 300, connector 310, fitting 330, tubing 340, bolt 350, nut 360, rivet 370, and cover 380. This embodiment also incorporates coupler 50*z* and the bayonet type mounting scheme to secure the valve body 70 to the coupler 50*z*. The alternative embodiment can use latches 60 and coupler 50 as in the first embodiment, or go without the latches, and use coupler 50*z* as shown in the additional embodiment of FIG. 22.

A handle is formed from elongated pressure relief valve outer housings as shown in FIG. 21*b*. The extended pressure relief valve housing 120*z* provides pressure relief through vent holes 126 and bores 124 and 125 as well as engage the hooked fingers 390, 392 of coupler 50*z* and provide a handle. The pressure relief valve outer housing 120*z* is roughly 50 mm longer than pressure relief valve outer housing 120 of the first embodiment. This provides a handle section of this housing. This section can be grasped by a human hand.

The valve 230 also has a rigid pneumatic connector 310*z* shown in FIG. 21*a* that can be grasped simultaneously by the user with the pressure relief valve outer housing 120*z* handle. The rigid pneumatic connector 310*z* (FIG. 21*a*) measuring roughly 50 mm in length and roughly 15 mm in diameter is dimensionally configured at threaded section 331 to attach to threaded bore 235 of valve 230. The other end is dimensionally configured for the insertion of filter screen 320 as well as an air supply connection 315. This connector 310*z* is also dimensionally configured as a lever for the placement of a thumb.

Tube release lever 210 is replaced by a torsion spring type of tube release 210*z* as shown in FIG. 22. Retaining ring 220 holds the torsion spring 210*z* in place. One simply squeezes the legs of the torsion spring together to release its grip on tube 190. Therefore, tube 190 can be positioned vertically into the container 30 as indicated by the arrow in FIG. 23 and then secured in place by torsion spring 210*z* in this embodiment.

Actuation of the apparatus 20*zz* is shown in FIG. 23. The valve 230 is positioned over the holes 75 of valve body 70 to allow pressurized air to enter the container 30. Squeezing together connector 310*z* and either handle of housing 120*z* (FIG. 23) compresses spring 140 and orients valve 230 over holes 75 and causes fluid to dispense in the same manner as the first embodiment. Releasing the connector 310*z* stops the fluid from dispensing in the same manner as the first embodiment.

Advantages (a) A plurality of adapters will permit connecting to many different containers that fluids/liquids are supplied in, will obviate the need to transfer the fluid to a specific container, and will reduce the possibility of cross-contamination of fluids.

(b) Eliminating the need of a specific container will permit the manufacturing of the fluid dispensing apparatus without having to supply a container, which is cheaper to manufacture, assemble, package, store, handle, and ship.

(c) Securely attaching the container to the dispensing apparatus permits easy transportation of the apparatus with one human hand to the desired area one wishes to dispense fluid.

(d) Once the correct dispensed fluid/liquid volume is achieved, the ability to quickly vent the air pressure inside the container is desirable for fast and accurate control of fluid flow.

(e) The ability to start and stop the fluid dispensing with the same hand that is used for carrying the dispensing apparatus and container permits a free hand for the holding and placing of the fluid dispensing hose.

(f) All pressurized vessels should have a pressure relief valve for safety. Using an orifice as an airflow restriction in cooperation with a pressure relief valve effectively controls the airflow and pressure, eliminating the need of a costly, heavy, and bulky air pressure regulator assembly, or the additional need to regulate the air supply before connecting to the fluid dispensing apparatus.

(g) The ability to easily release the fluid dispensing tube will provide fast removal of the tube for cleaning, and for quick depth adjustment of the tube when switching the dispensing apparatus to different depth containers.

(h) The use of an inlet air filter provides clean air for dispensing regardless of how dirty the air supply may be, preventing contamination of the fluid to be dispensed.

Accordingly, it will be seen that the fluid dispensing apparatus of the various embodiments can be used to dispense fluids/liquids conveniently and directly from the container the fluid is supplied in. In addition, these containers can be thin-walled plastic containers which, due to the pressure regulation capability of the dispensing apparatus, will not sustain damage. This method of dispensing saves time, greatly reduces the possibilities of cross-contamination of fluids, and substantially broadens the spectrum of containers which fluids/liquids can be dispensed from. Furthermore, the fluid dispensing apparatus has the additional advantages in that:

it can be carried around and simultaneously activated by a single human hand;

it can be carried around with various containers securely attached to it;

it instantly vents the air pressure inside the container when the actuation lever is released resulting in the dispensing fluid to immediately stop flowing;

it permits production of a dispensing apparatus with air pressure and flow regulation without the need of an expensive and bulky air pressure regulator assembly;

it allows for the use of standard, or more common air supply line pressures that do not need to be additionally regulated to a lower pressure before connection to the dispensing apparatus;

it permits pressurized dispensing from a variety of thin-walled plastic containers;

it provides simple and easy removal or depth adjustment of the fluid dispensing tube and hose assembly;

it allows for quick changing to a different depth container;

it permits production of a dispensing apparatus without having to supply a container also;

it provides filtering of the inlet air supply.

While my above description contains many specificities, these should not be construed as limitations on the scope, but rather as an exemplification of several embodiments thereof. Many other variations are possible. For example, the actuation lever can be configured to be finger operated. The handle can be a tube handle, which also provides an air supply path. The handle and frame can be molded plastic, or composite, with or without an air supply passage. The handle can have an air pressure control valve, or air on-off valve, incorporated in the handle.

The control valve can be finger or thumb operated. One of the pressure relief valves can be eliminated. A handle with or without an air supply passage can attach to where one of the pressure relief valves attach, thereby obviating the need of the handle and mounting plates of the first and second embodiment.

A tube guide bushing can be used to provide the air pressure relief, as well as the venting of the air pressure inside the container. This can be done with a flat seat on the underside of the bushing which contacts the top of the valve body, and that is held down under spring tension. It can lift off the seat when container air pressure acts on it. The spring tension for holding the guide bushing on its seat can be provided by a tube release lever formed from spring steel sheet.

This type of tube guide bushing, along with an air pressure on-off valve, obviates the need for the pneumatic valve, as well as the vent holes in the valve body of the first, additional, and alternative embodiments. This would also eliminate the need for the close tolerance of the valve body outside diameter.

The latch can be a single latch instead of two. It can be made of spring steel sheet material, and of a one-piece construction formed in somewhat of a "∩" shape. It can have the legs configured to connect to the coupler of the first embodiment. The inside radius of the "∩" can be configured for the latch pivot point, and have tabs extending upward on each side past the radius for the placement of a thumb and finger for releasing the latch. This latch, along with the pressure relieving tube guide bushing, and with the above elimination of the pneumatic valve, would obviate the need of the latch and valve return spring, the latch return washer, and the pressure relief valves of the first, additional, and alternative embodiments.

The coupler can be similar to a well known air hose quick-coupler. The fluid dispensing tube can be a multiple section telescoping type of tube, or a flexible plastic tube. The filter can be a flat disc, conical, cylindrical, and constructed of screen materials, plastic materials, metal materials, the materials can be sintered, etc.

Accordingly, the scope should be determined not by the embodiments illustrated, but by the appended claims and their legal equivalents.

I claim:

1. A method of pneumatically dispensing fluids comprising:

(a) providing a pneumatic fluid dispensing apparatus, the apparatus including:

(i) a tubular valve body with a closed end defining an interior chamber and a plurality of transverse apertures communicating between the interior chamber and valve body exterior;

(ii) an adapter-coupler mounted to the valve body, the coupler having a central passage contiguous to the interior chamber of the valve body;

(iii) a fluid dispensing tube extending axially through the closed end and the interior of said valve body and through said bore of said adapter-coupler and sized to extend to a container interior when the adapter-coupler is coupled to a container and sized to have a tube diameter that is less than a diameter of the coupler central passage and the chamber; and (iv) a valve member with an axial bore circumferentially disposed on the exterior of the tubular valve body and movable upwardly and downwardly between upper and lower positions;

(b) providing a container of fluid having an opening, a cap, a top and a bottom, and removing the cap of said container of fluid;

(c) attaching said adapter-coupler to the opening of said container of fluid;

(d) adjusting said fluid dispensing tube to communicate near the bottom of said container of fluid;

(e) connecting an air pressure supply to a radial gas passage in the valve member;

(f) orienting said radial gas passage of said valve member over said transverse apertures of the valve body to cause pressurized air to enter the interior chamber and into said container of fluid, and displace said fluid in said container of fluid causing said fluid to flow through said fluid dispensing tube and out of said container of fluid; and (g) removing the valve member from over the apertures of the valve body to vent the interior chamber pressure and container pressure to stop the flow of fluid through the dispensing tube;

(h) whereby a human can pneumatically dispense any one of a variety of fluids directly from any one of a plurality of sealed containers having any one of said variously configured openings while carrying and operating said pneumatic fluid dispensing apparatus connected to said sealed fluid container with one hand, henceforth allowing the other hand to be free to perform other tasks.

2. A pneumatic fluid dispensing apparatus, comprising:

(a) a tubular valve body with a closed end defining an interior chamber and a plurality of transverse apertures communicating between the interior chamber and the valve body exterior;

(b) a container coupling mounted to the valve body, the coupling having a central passage contiguous with the interior chamber of the valve body;

(c) a central tube extending axially through the closed end and the interior of said valve body and through said bore of said container coupling and sized to extend to a container interior when the container coupling is coupled to a container and sized to have a tube diameter that is less than a diameter of the coupling central passage and the chamber;

(d) a valve member with an axial bore circumferentially disposed on the exterior of the tubular valve body and movable upwardly and downwardly between upper and lower positions; and (e) a source of compressed gases coupled to a radial gas passage in the valve member;

(f) wherein gas from the source of compressed gases is emitted through the gas passage of the valve member through the transverse apertures of the valve body to the interior chamber of the valve body, central passage of the container coupling and a coupled container interior when the valve member is oriented over the valve body apertures;

(g) wherein gasses from the interior chamber and container interior are vented out of the valve body when the valve member is not oriented over the valve body apertures; and (h) wherein gas pressure in the container interior causes fluid in the container to flow through the interior of the central tube and venting stops the flow of fluid through the central tube.

3. The apparatus as recited in claim 2, further comprising at least one pressure relief valve operably coupled to the valve body configured to open when the gas pressure in the interior chamber of said valve body exceeds a predetermined level.

4. The apparatus as recited in claim 3, wherein at least one of said pressure relief valves opens at a chamber pressure that is less than the pressure of compressed gas entering the chamber from the gas passage of the valve member.

5. The apparatus as recited in claim 2, further comprising a spring configured to resist the movement of the valve member from the upper to lower position along the valve body.

6. The apparatus as recited in claim 2, wherein said tubular valve body and said container coupling are reversibly connected, said container coupling having a seat adapted to receive and seat an open end of the tubular valve body, said valve body further comprising a seal.

7. The apparatus as recited in claim 6, wherein said container coupler comprises:

a container adaptor configured to reversibly engage an opening of a container; and a valve body coupler configured to seat the valve body and adapted to mount to the container adaptor.

8. The apparatus as recited in claim 2, further comprising a delivery hose mounted to the central tube, wherein fluid from a pressurized container interior flows through the central tube and out of the delivery hose.

9. The apparatus as recited in claim 2, wherein said tubular valve body further comprises:

an end bushing with a central axial channel and at least one seal mounted to an end of the tubular valve body to define the interior chamber, the central tube axially disposed and sealed in the central axial channel;

wherein the position of the central tube in relation to the tubular valve body can be adjusted upwardly or downwardly; and wherein an end of the central tube can be positioned into the liquid of a container.

10. The apparatus as recited in claim 2, wherein said valve member further comprises an interior annular groove open to the axial bore of the valve member and to the gas passage.

11. The apparatus as recited in claim 2, further comprising:

a support mounting bracket with a handle, said valve body mounted to the bracket; and an actuation lever pivotally mounted to the valve member and to the mounting bracket;

wherein pivotal movement of the actuation lever causes the linear movement of the valve member along the exterior of the valve body.

12. The apparatus as recited in claim 2, wherein said handle further comprises:

a pneumatic hose quick connect;

an air supply tube coupled to the gas passage of the valve member and to the pneumatic hose quick connect; and a handle cover.

13. A pneumatic fluid dispensing apparatus, comprising:

(a) a container coupling having a central passage, seat and top and a bottom couplings, the bottom coupling adapted to engage a container, the top coupling comprising an opposing pair of receptacles;

(b) a tubular valve body with an open end, a closed end defining an interior chamber and a plurality of transverse apertures communicating between the interior chamber and valve body exterior;

(c) a pair of pressure relief valves mounted radially to the valve body at opposite sides of the valve body, the relief valves having an elongate housing;

(d) a valve member with a radial gas passage and an axial bore, the valve member disposed circumferentially on the exterior of the tubular valve body and movable upwardly and downwardly between upper and lower positions;

(e) a rigid gas supply line mounted radially to the valve member and radial gas passage of the valve member connected to a source of pressurized gas;

(f) a central tube extending axially through the closed end and the interior of said valve body and through said bore of said container coupling and sized to extend to a container interior when the container coupling is coupled to a container and sized to have a tube diameter that is less than a diameter of the coupling central passage and the chamber;

(g) wherein the bottom end of the valve body is seated in the seat of the container coupling and the elongate housings of the pressure relief valves engage the top coupling receptacles of the container coupling to couple the valve body and container coupling;

(h) wherein gas from the source of compressed gas is emitted through the gas passage of the valve member through the transverse apertures of the valve body to the interior chamber of the valve body, central passage of the container coupling and a coupled container interior when the valve member is oriented over the valve body apertures;

(i) wherein gasses from the interior chamber and container interior are vented out of the valve body when the valve member is not oriented over the valve body apertures; and (j) wherein gas pressure in the container interior causes fluid in the container to flow through the interior of the central tube and venting stops the flow of fluid through the central tube.

14. The apparatus as recited in claim 13, further comprising a spring configured to resist the movement of the valve member from the upper to lower position along the valve body.

15. The apparatus as recited in claim 13, wherein at least one of said pressure relief valves opens at a chamber pressure that is less than the pressure of compressed gas entering the chamber from the gas passage of the valve member.

16. The apparatus as recited in claim 13, further comprising a delivery hose mounted to the central tube, wherein fluid from a pressurized container interior flows through the central tube and out of the delivery hose.

17. The apparatus as recited in claim 13, wherein said rigid gas supply line is connected to a source of pressurized gas with a pneumatic hose quick connect.

18. The apparatus as recited in claim 13, wherein said rigid gas supply line further comprises a filter.

19. The apparatus as recited in claim 13, wherein said tubular valve body further comprises:

an end bushing with a central axial channel and at least one seal mounted to an end of the tubular valve body to define the interior chamber, the central tube axially disposed and sealed in the central axial channel;

wherein the position of the central tube in relation to the tubular valve body can be adjusted upwardly or downwardly; and wherein an end of the central tube can be positioned into the liquid of a container.

20. The apparatus as recited in claim 13, wherein said valve member further comprises an interior annular groove open to the axial bore of the valve member and to the gas passage.

* * * * *